US007954936B2

(12) United States Patent
Hattori

(10) Patent No.: US 7,954,936 B2
(45) Date of Patent: Jun. 7, 2011

(54) INK CARTRIDGES AND INK SUPPLY SYSTEMS

(75) Inventor: Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 892 days.

(21) Appl. No.: 11/866,996

(22) Filed: Oct. 3, 2007

(65) Prior Publication Data

US 2008/0084462 A1 Apr. 10, 2008

(30) Foreign Application Priority Data

Oct. 6, 2006 (JP) ..... 2006-274884
Oct. 6, 2006 (JP) ..... 2006-275858

(51) Int. Cl.
*B41J 2/175* (2006.01)

(52) U.S. Cl. ..... 347/86; 347/84

(58) Field of Classification Search ..... 347/84, 347/85, 86
See application file for complete search history.

(56) References Cited

U.S. PATENT DOCUMENTS

| | | | | |
|---|---|---|---|---|
| 4,383,263 | A * | 5/1983 | Ozawa et al. | 347/30 |
| 4,628,333 | A * | 12/1986 | Terasawa | 347/87 |
| 4,631,554 | A * | 12/1986 | Terasawa | 347/30 |
| 5,485,187 | A | 1/1996 | Okamura et al. | |
| 6,113,228 | A | 9/2000 | Pawlowski, Jr. et al. | |
| 6,755,500 | B2 * | 6/2004 | Hirano et al. | 347/22 |
| 7,410,248 | B2 * | 8/2008 | Umeda et al. | 347/85 |
| 2004/0174417 | A1 | 9/2004 | Kobayashi et al. | |
| 2005/0195225 | A1 | 9/2005 | Takagi et al. | |
| 2006/0244790 | A1 | 11/2006 | Umeda | |

FOREIGN PATENT DOCUMENTS

| | | | |
|---|---|---|---|
| EP | 0 950 533 | A | 10/1999 |
| EP | 0 965 451 | A | 12/1999 |
| JP | 5138893 | A | 6/1993 |
| JP | 05-318760 | A | 12/1993 |
| JP | 7089081 | A | 4/1995 |
| JP | 2000085141 | A | 3/2000 |
| JP | 2002321379 | A | 11/2002 |
| JP | 2005246781 | A | 9/2005 |
| JP | 2006035482 | A | 2/2006 |
| JP | 2006327186 | A | 12/2006 |

OTHER PUBLICATIONS

European Search Report issued in corresponding Patent Application No. EP 07 01 9579, mailed on Dec. 21, 2007.
The State Intellectual Property Office of the People's Republic of China; Notification of First Office Action in Chinese Patent Application No. 200710149979.9 (counterpart to the above-captioned U.S. patent application).

* cited by examiner

*Primary Examiner* — Anh T. N. Vo
(74) *Attorney, Agent, or Firm* — Baker Botts L.L.P.

(57) ABSTRACT

An ink cartridge includes an ink chamber configured to store ink. The ink chamber is defined by at least one wall, and an air layer is formed in the ink chamber between a surface of the ink and a portion of the wall. The ink cartridge also includes a pump for selectively supplying air to the air layer and to draw air from the air layer. An ink supply system includes a first ink tank including an ink chamber defined by at least one wall, and an air layer is formed in the ink chamber between a surface of the ink and a portion of the wall. The ink supply system also includes a pump for selectively supplying air to the air layer and to draw air from the air layer, and a second ink tank in fluid communication with the first ink tank.

34 Claims, 20 Drawing Sheets

(a)

(b)

INK CARTRIDGES AND INK SUPPLY SYSTEMS

CROSS-REFERENCE TO RELATED APPLICATIONS

The present application claims priority from Japanese Patent Application No. JP-2006-274884, which was filed on Oct. 6, 2006, and Japanese Patent Application No. JP-2006-275858, which was filed on Oct. 6, 2006, the disclosures of which are incorporated by reference in its entirety.

BACKGROUND OF THE INVENTION

1. Field of the Invention

The present invention relates generally to ink cartridges and ink supply systems. In particular, the present invention is directed towards ink cartridges which may be used in combination with ink jet printers, and towards ink supply systems applicable to ink jet printers.

2. Description of Related Art

A known inkjet printer has a recording head from which ink is discharged onto a sheet of paper to form images on the sheet of paper. The known inkjet printer also has a main ink tank, and a sub ink tank mounted on the recording head. The main ink tank and the sub ink tank are in fluid communication with each other via an ink supply path formed by a flexible tube. The known inkjet printer also has an ink supply mechanism such as a positive displacement pump. The pump is provided in the ink supply path between the main ink tank and the sub ink tank and is configured to supply ink from the main ink tank to the sub ink tank. Ink is drawn into the inside of the pump and then is pressurized by the pump to be supplied to the sub ink tank. In some cases, the main ink tank and the pump are disposed in a cartridge, and the cartridge is configured to be removable from the inkjet printer.

Nevertheless, since the pump is provided in the ink supply path, ink may leak from the pump if the pump breaks, the tubing of the pump ages and deteriorates, or the pump sealing deteriorates.

Another known inkjet printer has a recording head from which ink is discharged onto a sheet of paper to form images on the sheet of paper. The known inkjet printer also has an ink tank storing ink therein. The recording head and the ink tank are in fluid communication with each other via an ink supply path formed by a tube. The known inkjet printer also has a pump provided in the ink supply path between the ink tank and the recording head. The pump is configured to supply ink from the ink tank to the recording head and also return ink from the recording head to the ink tank. When ink is returned from the recording head to the ink tank, air bubbles, which may have been trapped in the recording head or the tube, or both, flows into the ink tank. Air bubbles are separated from ink in an ink chamber provided in ink tank. Thus, air bubbles are removed from recording head or the tube, or both.

Yet Another known inkjet printer has an ink tank, and the ink tank has a valve configured to allow and prevent fluid communication between the ink tank and a recording head. The valve is accommodated in a valve accommodating chamber provided in the ink tank.

If the ink tank of the known inkjet printer third described above is applied to the known inkjet printer second described above, ink in the valve accommodating chamber also needs to be returned to the ink chamber as well as ink in the recording head and the tube. This is because, if some of the ink in the recording head and the tube is left in the valve accommodating portion, air bubbles trapped in the ink may adhere to the valve, which may disturb the movement of the valve. Moreover, the air bubbles adhering to the valve may return into the tube and the recording head when ink is supplied from the ink tank to the recording head. Nevertheless, a more powerful pump having relatively high capacity may be more effective in returning ink in the valve accommodating chamber to the ink chamber as well as ink in the recording head and the tube.

SUMMARY OF THE INVENTION

A need has therefore arisen for ink cartridges and ink supply systems which overcome these and other shortcomings of the related art. A technical advantage of the present invention is to prevent ink leakage from a pump and to supply ink with high reliability. Another technical advantage of the present invention is to separate air bubbles from ink and to prevent air bubbles from staying in the valve accommodating chamber.

According to an embodiment of the invention, an ink cartridge comprises an ink chamber configured to store ink therein, wherein the ink chamber is defined by at least one wall, and an air layer is formed in the ink chamber between a surface of the ink and at least a portion of the at least one wall, and a pump configured to selectively supply air to the air layer and to draw air from the air layer.

According to another embodiment of the invention, an ink supply system comprises a first ink tank comprising an ink chamber configured to store ink therein, wherein the ink chamber is defined by at least one wall, and an air layer is formed in the ink chamber between a surface of the ink and at least a portion of the at least one wall, and a pump is configured to selectively supply air to the air layer and to draw air from the air layer, and a second ink tank configured to store ink. The first ink tank and the second ink tank are configured to be in fluid communication with each other.

According to an embodiment of the invention, an ink cartridge comprises an ink chamber configured to store ink therein, wherein the ink chamber is defined by at least one wall, a side wall having a first opening formed therethrough, a particular wall extending from the side wall toward the ink chamber, having a second opening formed therethrough, a valve accommodating chamber defined by the particular wall and configured to be in fluid communication with an outside of the ink cartridge via the first opening, and to be in fluid communication with the ink chamber via the second opening, a valve accommodated in the valve accommodating chamber, the valve configured to move in the valve accommodating chamber to selectively allow and prevent fluid communication between the valve accommodating chamber and the outside of the ink cartridge via the first opening. The second opening is positioned above both the valve accommodating chamber and the first opening.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

FIG. 2(*b*) is an expanded cross sectional view of the recording unit when the sub ink tank is in fluid communication with the atmosphere, according to an embodiment of the present invention.

FIG. 3(*b*) is a perspective view of the ink cartridge of FIG. 3(*a*) with the case disassembled.

FIG. 12(*b*) is a partial cross sectional view of the air communication portion when the valve is positioned at P2.

DETAILED DESCRIPTION OF EMBODIMENTS

Embodiments of the present invention, and their features and advantages, are understood by referring to FIGS. 1-20(*c*), like numerals being used for like corresponding parts in the various drawings.

Figure 1:
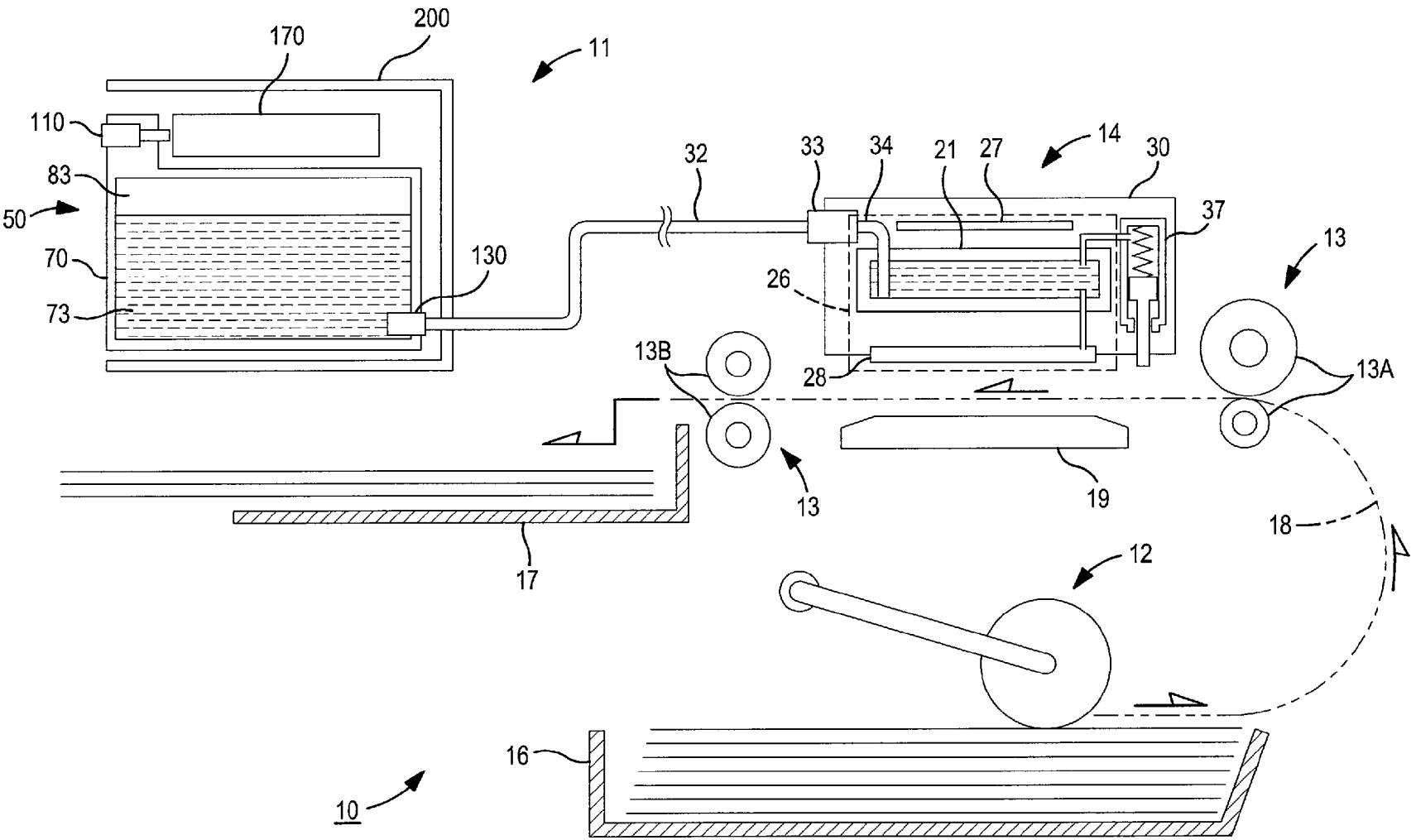
FIG. 1 is a simplified cross sectional view of an inkjet recording apparatus, according to an embodiment of the present invention.
Figure 2:
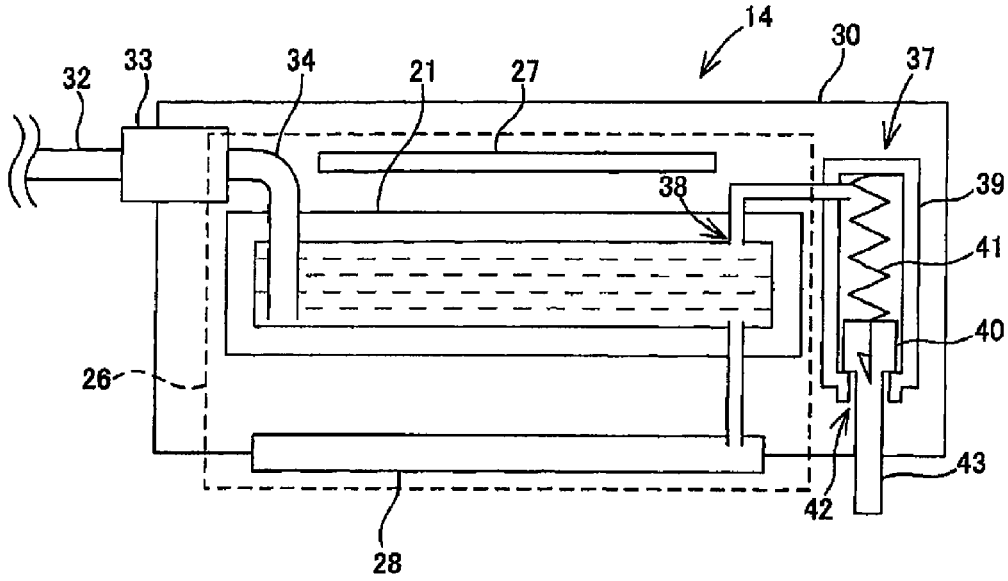
FIG. 2(*a*) is an expanded cross sectional view of a recording unit when a sub ink tank is not in fluid communication with the atmosphere, according to an embodiment of the present invention.
Figure 2:
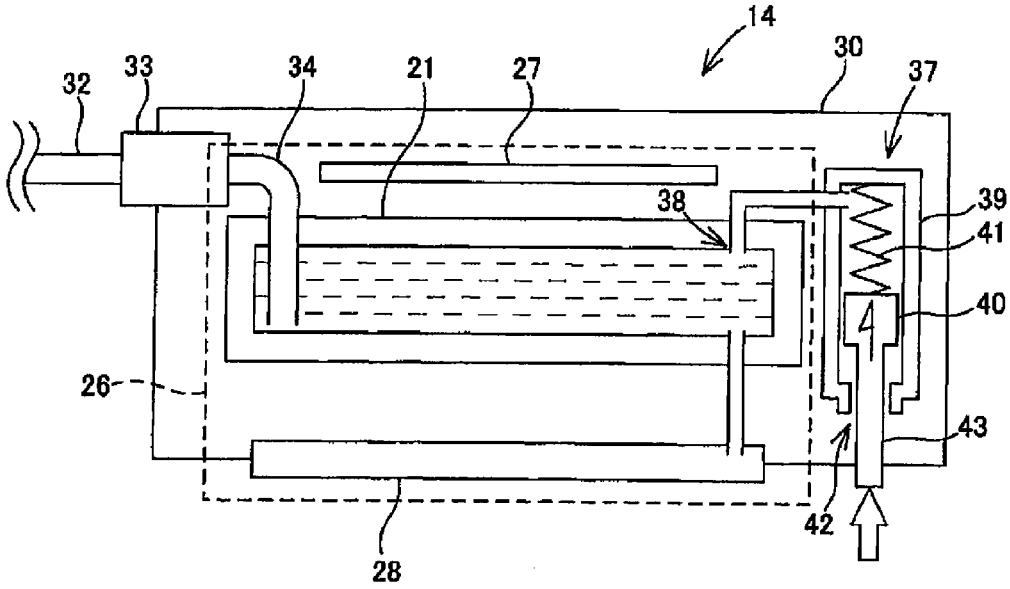

Referring to FIGS. 1, 2(*a*) and 2(*b*), an inkjet recording device 10 may be configured to record images, e.g., color images or monochrome images, on a recording medium e.g., a sheet of paper, using black ink or a plurality of, e.g., five, colors of inks, e.g. cyan ink, magenta ink, yellow ink, dye-based black ink, and pigment-based black ink. Inkjet recording device 10 may comprise a paper feed device 12, a convey device 13, a recording unit 14, an ink supply system 11, a paper tray 16, and a discharge tray 17. Paper tray 16 may be configured to accommodate recording media, e.g., sheets of paper, and the recording media may be fed by paper feed device 12 to a paper path 18. Paper path 18 may have a sideways "U" shape, and convey device 13 may be provided along paper path 18. Convey device 13 may comprise a pair of convey rollers 13A, a pair of discharge rollers 13B, and a platen 19. Convey rollers 13A may be positioned on the upstream side of recording unit 14 in paper path 18, and discharge rollers 13B may be positioned on the downstream side of recording unit 14 in paper path 18.

Convey rollers 13A may be configured to convey the sheet fed by paper feed device 12 to platen 19. Recording unit 14 may be positioned directly above platen 19, and may be configured to record images on the sheet passing over platen 19. Discharge rollers 13B may be configured to contact, position, and start conveying the sheet when the leading edge of the sheet reaches discharge rollers 13B. Both convey rollers 13A and discharge rollers 13B may be configured to convey the sheet until the trailing edge of the sheet passes between convey rollers 13A. After the sheet has passed between convey rollers 13A, the sheet may be conveyed by discharge rollers 13B only. Discharge tray 17 may be positioned at downstream end of paper path 18. Discharge rollers 13B may be configured to discharge the sheet, on which the image may be recorded, to discharge tray 17.

Recording unit 14 may comprise a carriage 30, at least one sub ink tank 21, a head control board 27, and a recording head 26. Carriage 30 may be supported by rails configured to allow carriage 30 to slide, and may be configured to slide in a back-and-forth direction when inkjet recording device 10 is positioned as shown in FIG. 1. Sub ink tank 21 may be configured to store ink to be supplied to recording head 26. A plurality of, e.g., five, sub ink tanks 21 may be provided, corresponding to the five colors of inks, respectively.

Recording head 26 may comprise a plurality of nozzles 28 through which ink may be ejected toward the sheet of paper, based on image signals input to head control board 27. Inkjet recording device 10 may comprise a main controller, which may be configured to perform overall control of inkjet recording device 10, and the main controller may output image signals to head control board 27. Carriage 30 may comprise a side face having at least one joint 33 provided thereon. At least one flexible tube 32 may be connected to the at least one joint 33. A plurality of, e.g., five, tubes 32, and a plurality of, e.g., five, joints 33 may be provided, corresponding to the five colors of inks, respectively. A path 34 may be provided in carriage 30, extending from joint 33 to the bottom of sub ink tank 21. A valve mechanism 37 may be provided in carriage 30, and valve mechanism 37 may comprise a cylinder 39, which may be in fluid communication with one or more of sub ink tank 21, a coil spring 41, and a piston 40. Coil spring 41 and piston 40 may be accommodated in cylinder 39, which may comprise a bottom wall, and may have an opening 42 formed through the bottom wall of cylinder 39. Coil spring 41 may be compressed, and may urge piston 40 in a direction that may cause opening 42 to close. A rod 43 may extend from piston 40 through opening 42, to the outside of cylinder 39.

Referring to FIG. 2(*b*), when a force is applied to rod 43 in a direction opposite the direction of the urging force of coil spring 41, piston 40 may be configured to move within cylinder 39 against the urging force of coil spring 41 to open opening 42. The inside of sub ink tank 21 may be configured to be in fluid communication with the atmosphere via cylinder 39 and opening 42 when opening 42 is opened. When ink flows into or out of sub ink tank 21 via tube 32, opening 42 may be opened. When inkjet recording device 10 is in a waiting state, e.g., a state in which inkjet recording device 10 does not perform recording, opening 42 may be closed to prevent ink evaporation.

Referring again to FIG. 1, ink supply system 11 may comprise a cartridge mounting portion 200, at least one ink cartridge 50, at least one flexible tube 32, and at least one sub ink tank 21. Cartridge mounting portion 200 may be configured to detachably mount at least one ink cartridge 50 therein. Ink cartridge 50 may comprise a tank for storing ink, e.g., main ink tank 70. Main ink tank 70 and sub ink tank 21 may be configured to be in fluid communication via tube 32. A plurality of, e.g., five, tubes 32, may be connected to a plurality of, e.g., five, main ink tanks 70 of a plurality of, e.g., five, ink cartridges 50 and a plurality of, e.g., five, sub ink tanks 21, respectively. Ink may flow between main ink tank 70 and sub ink tank 21 bi-directionally via tube 32. Tube 32 may comprise at least one flexible synthetic resin, and may be configured to be flexed and to follow the movement of carriage 30 when carriage 30 reciprocates.

When ink in sub ink tank 21 and tube 32 is returned to main ink tank 30, air bubbles, which may have been trapped in sub ink tank 21 and tube 32, may be transferred to main ink tank 30 along with the ink, and may be separated from ink inside main ink tank 30. After that, ink may be supplied from main ink tank 70 to sub ink tank 21. Consequently, ink in sub ink tank 21 may be replaced with ink in main ink tank 70, and ink in sub ink tank 21 and ink in main ink tank 70 may be mixed. Thus, the viscosity of ink may be equalized by the mixture.

Figure 3:
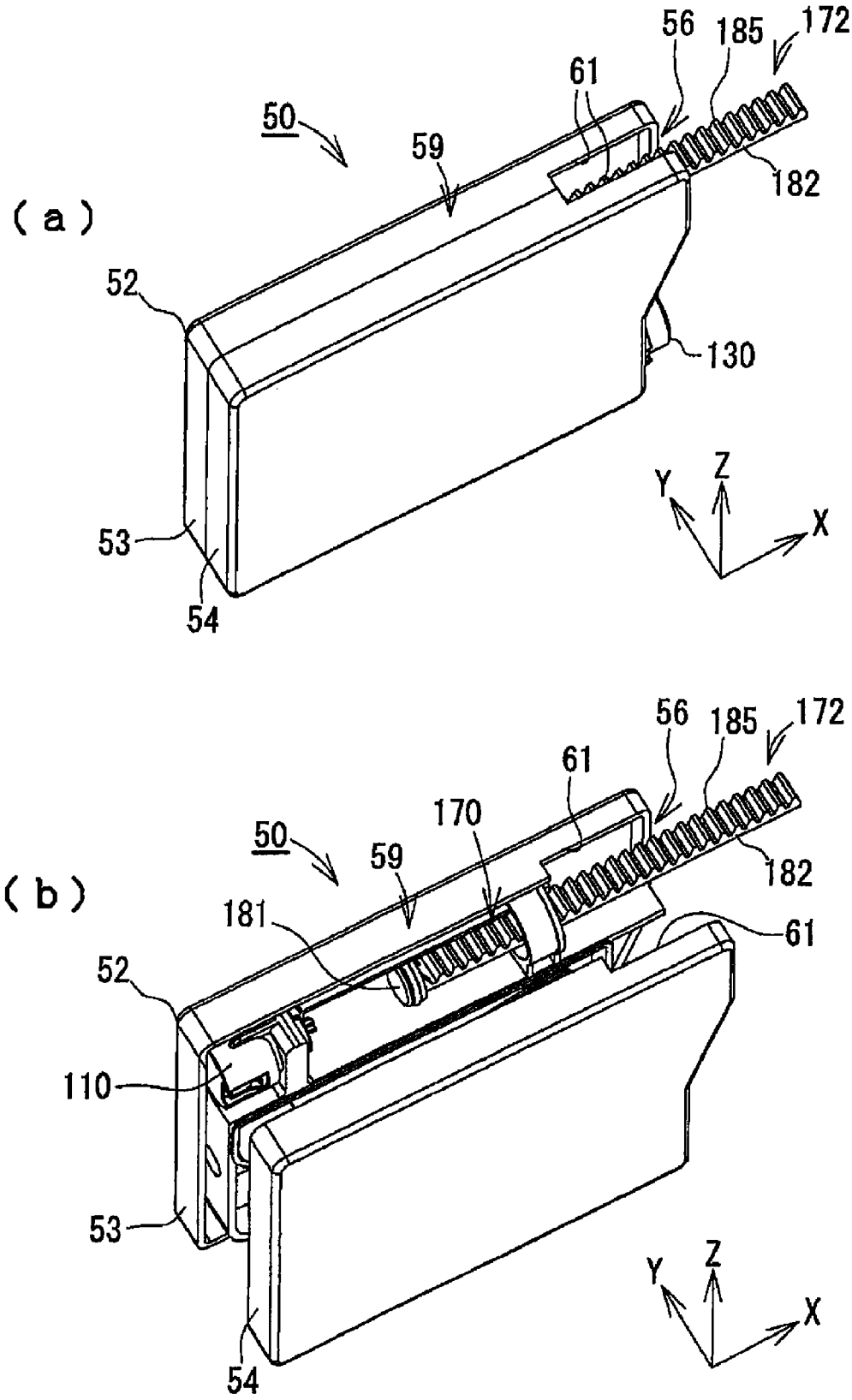
FIG. 3(*a*) is a perspective view of an ink cartridge with a case assembled, according to an embodiment of the present invention.
Figure 4:
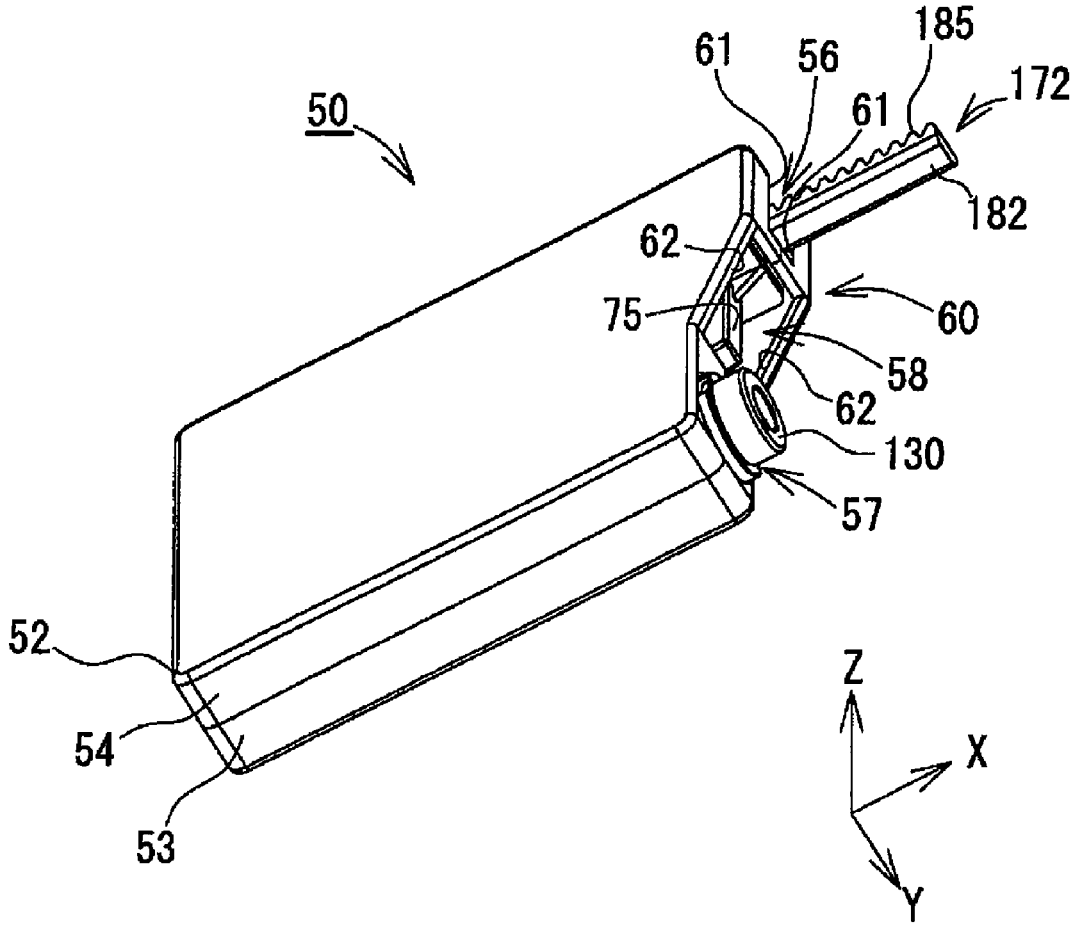
FIG. 4 is a perspective view of the ink cartridge of FIG. 3(*a*) from a different angle.
Figure 5:
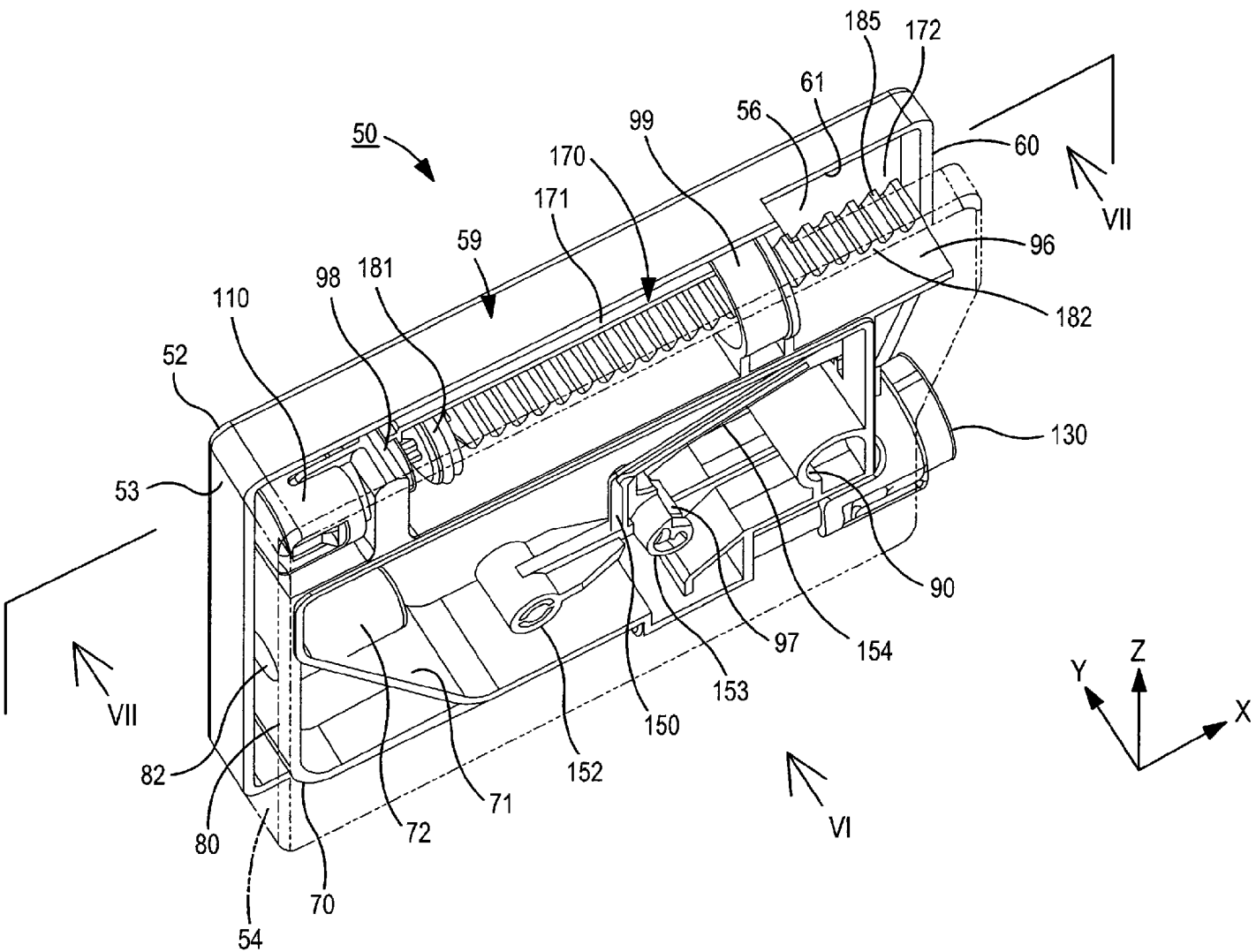
FIG. 5 is a perspective view depicting an internal structure of the ink cartridge according to an embodiment of the invention.

Referring now to FIGS. 3 to 9, ink cartridge 50 may comprise a case 52, which may have a rectangular parallelepiped shape, having a width in Y-axis direction when positioned as shown in FIGS. 3 to 5, a height in Z-axis direction when positioned as shown in FIGS. 3 to 9, and a depth in an X-axis direction when positioned as shown in FIGS. 3 to 9. The height may be greater than the width, and the depth may be greater than the height. An X-axis direction may be parallel with a direction in which ink cartridge 50 is mounted into cartridge mounting portion 200. An X-Y plane which is defined by an X axis and a Y axis may be a horizontal plane. An X-axis, a Y-axis, and a Z-axis may be perpendicular to one another.

Case 52 may comprise a first case member 53 and a second case member 54. Case 52 may be configured to be selectively disassembled into first case member 53 and second case member 54 along an X-axis direction when case 52 is positioned as shown in FIG. 3. The shape of first case member 53 may be substantially the same as the shape of second case member 54. Each of first case member 53 and second case member 54 may comprise at least one synthetic resin, and may be manufactured by injection molding.

Case 52 may comprise a top face 59 and a front face 60. Front face 60 has a first end and a second end, and top face 59 may be connected to the first end of front face 60. Opening 56 may be formed through top face 59, and may extend to front face 60, and may be defined by cut-out portions 61 formed in first case member 53 and second case member 54, respectively. A portion of a rod 182, which will be described in more detail herein, may be positioned in opening 56, and rod 182 may be configured to extend from front face 60. Opening 57 may be formed through front face 60, adjacent to the second end of front face 60. Opening 57 may be defined by semicircular cut-out portions formed in first case member 53 and second case member 54, respectively. An ink supply portion 130 may extend from the inside of case 52 to the outside of case 52 through opening 57. Opening 58 may be formed through front face 60 between opening 56 and opening 57, and may be defined by rectangular cut-out portions 62 formed in first case member 53 and second case member 54, respectively. Detection portion 75 may be positioned in the inside of case 52 and exposed to the outside of case 52 through opening 58.

Figure 6:
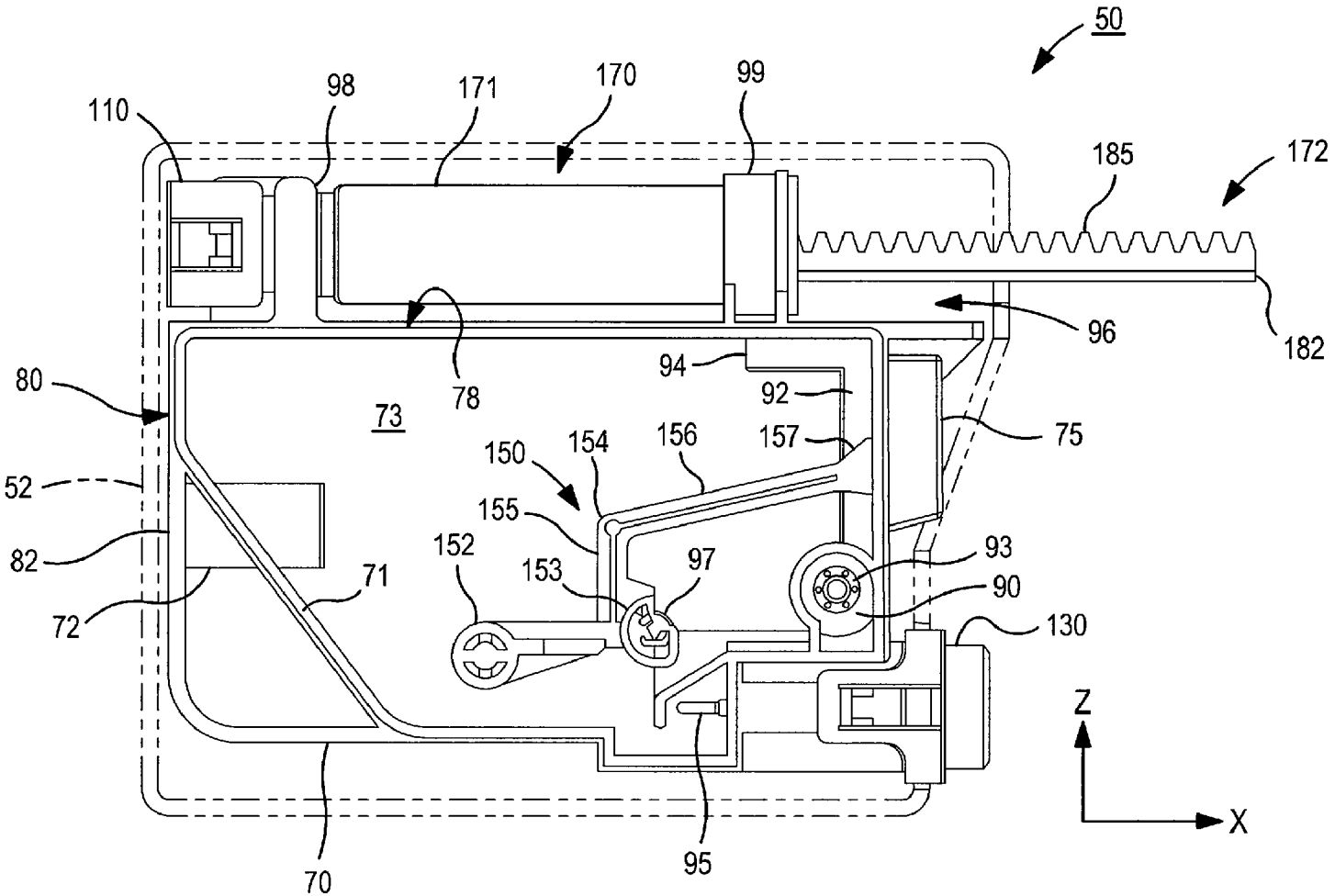
FIG. 6 is a side view of the internal structure seen along an arrow VI in FIG. 5.
Figure 7:
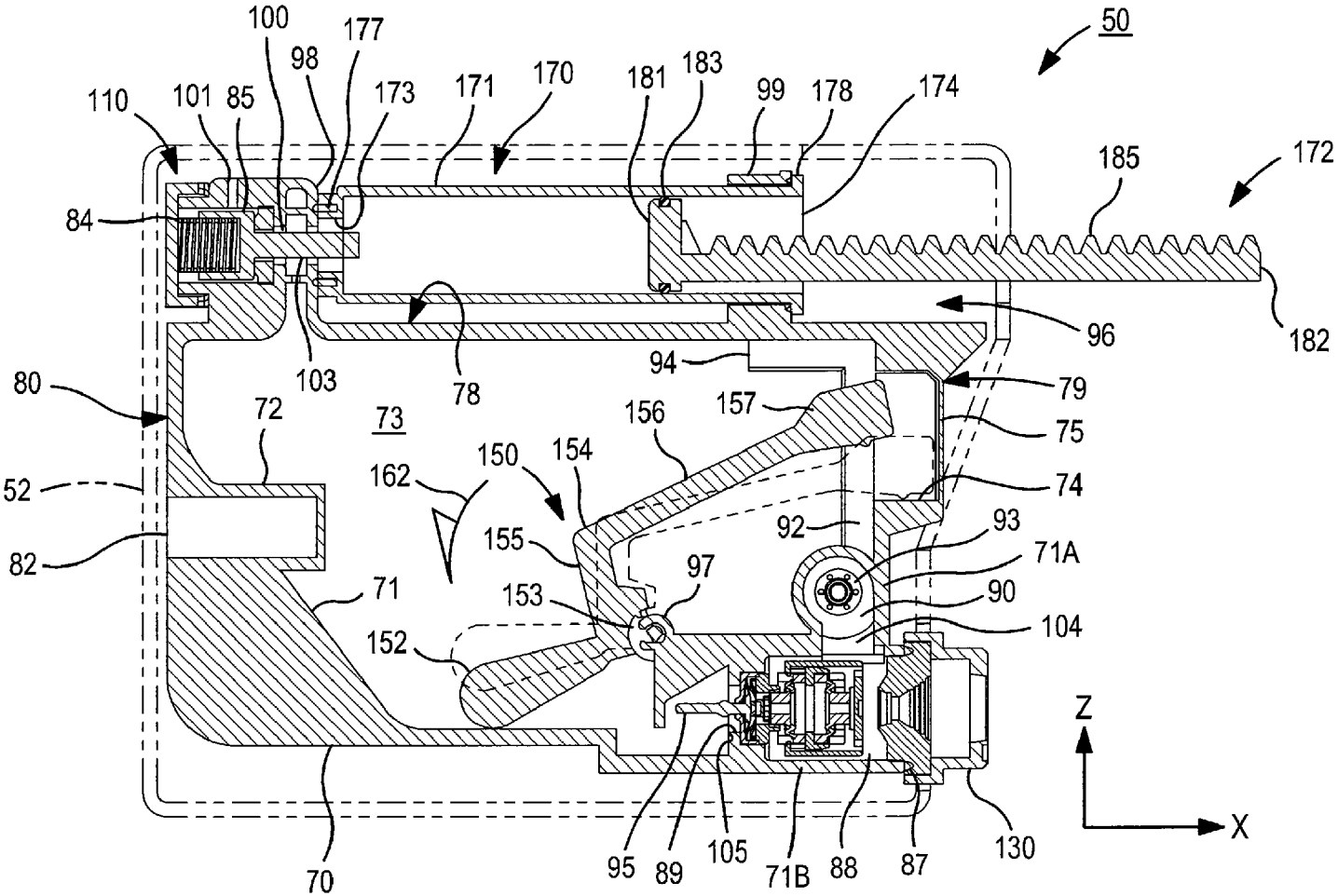
FIG. 7 is a cross sectional view of the ink cartridge taken along the VII-VII line in FIG. 5.

Referring to FIGS. 5 to 7, ink cartridge 50 may comprise, main ink tank 70, a pump 170, an air communication portion 110, and ink supply portion 130. At least a portion of each of main ink tank 70, pump 170, air communication portion 110, and ink supply portion 130 may be positioned in case 52. Each of main ink tank 70, pump 170, air communication portion 110, and ink supply portion 130 may comprise at least one synthetic resin. Main ink tank 70 may be substantially enclosed in case 52 and may have a width in a Y-axis direction, a height in a Z-axis direction, and a depth in an X-axis direction, when main ink tank 70 is positioned as shown in FIG. 5. The height of main ink tank 70 may be greater than the width of main ink tank 70, and the depth of main ink tank 70 may be greater than the height. Main ink tank 70 may comprise a translucent frame 71 and translucent films (not shown) welded to both side faces of frame 71. Frame 71 and films may define an ink chamber 73 therein for storing ink.

Figure 10:
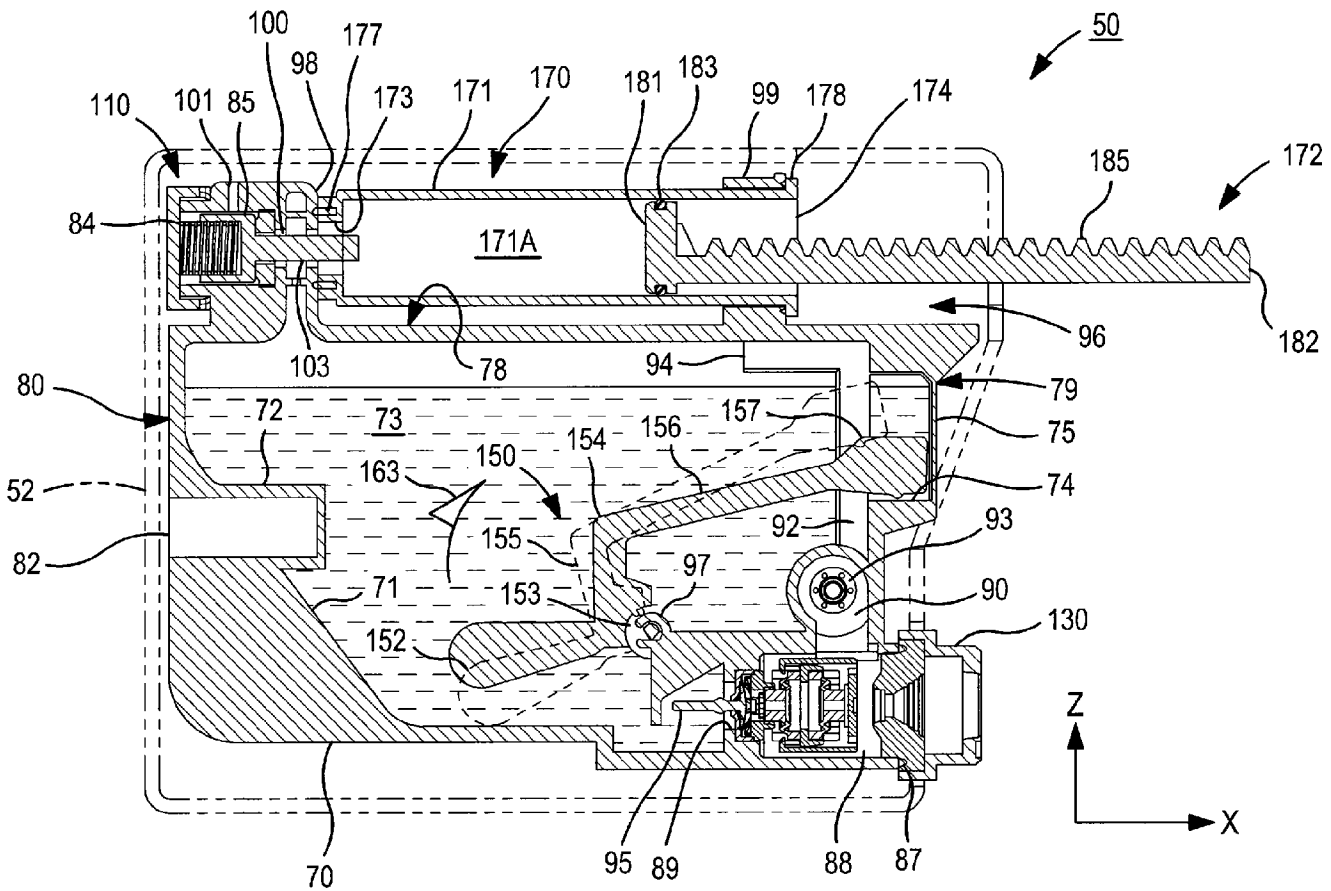
FIG. 10 is a cross sectional view of the ink cartridge when the ink cartridge is filled with a predetermined amount of ink, according to an embodiment of the invention.

Referring to FIGS. 5 to 8, main tank 70 may comprise a cylindrical ink fill portion 72, and ink fill portion 72 may be integrally formed with frame 71. An ink fill opening 82 may be formed through a rear face 80 of main tank 70. Ink fill portion 72 may extend from ink fill opening 82 toward ink chamber 73 in an X-axis direction. Ink chamber 73 may be configured to be filled with a predetermined amount of ink via ink fill opening 82, and ink fill portion 72. The predetermined amount of ink may be about 80% of a maximum capacity of ink chamber 73. Ink chamber 73 may comprise an upper portion closer to air communication portion 110 and a lower portion closer to ink supply portion 130. Referring to FIG. 10, an air layer 83 may be formed at the upper portion of ink chamber 73. After ink chamber 73 is filled with ink, a rubber plug may be press-fitted in ink fill portion 72, from ink fill opening 82. Ink chamber 73 may be hermetically closed after ink chamber 73 is filled with ink because ink supply portion 130 and air communication portion 110 also may be closed, as will be described further herein.

Referring now to FIGS. 7 to 11, rear face 80 may comprise an upper end and a lower end, and a circular opening 84 may be formed through rear face 80 of main ink tank 70, adjacent to the upper end of rear face 80. A cylindrical valve accommodating chamber 85 may be formed in main ink tank 70, and valve accommodating chamber 85 may extend from opening 84 in an X-axis direction. A piston 116 of a valve 113, a coil spring 112, and a valve seat 114 may be accommodated within valve accommodating chamber 85. Valve accommodating chamber may comprise an end opposite opening 84 in an X-axis direction. An opening 100 may be formed at the end of valve accommodating chamber 85, and opening 100 may be in fluid communication with the upper portion of ink chamber 73. In particular, opening 100 may be in fluid communication with air layer 83, formed at the upper portion of ink chamber 73. A portion of rod 117 of valve 113 may be positioned in opening 100. The diameter of opening 100 may be greater than the outer diameter of rod 117. Rod 117 therefore may not close opening 100, and air communication between valve accommodating chamber 85 and ink chamber 73 may not be prevented. A cross section of rod 117 taken along a plane perpendicular to an X-axis direction may have a cross shape. Valley portions 117B of rod 117 may be configured to allow air to pass therethrough. Valve accommodating chamber 85 may comprise a cylindrical wall surface extending from opening 84 to the end of valve accommodating chamber 85. An opening 101 may be formed in the wall surface of valve accommodating chamber 85, and may be in fluid communication with the atmosphere. Air communication portion 110 may be configured to alternately allow and prevent fluid communication between opening 100 and opening 101.

Referring to FIGS. 7-9 and 14, main ink tank 70 may comprise side wall 71A defining a front face 79 of main ink tank 70. Side wall 71A may comprise an upper end and a lower end, and a circular opening 87 may be formed through side wall 71A, adjacent to the lower end of side wall 71A. A cylindrical valve accommodating chamber 88 may be formed in main ink tank 70, and valve accommodating chamber 88 may extend from opening 87 in an X-axis direction, toward ink chamber 73. A valve 133 and a spring unit 134 may be accommodated within valve accommodating chamber 88. Main ink tank 70 may comprise a cylindrical wall 71B, extending from side wall 71A, and defining valve accommodating chamber 88 therein. Cylindrical wall 71B also may comprise an end wall 105, which may define an end of valve accommodating chamber 88 opposite opening 87 in an X-axis direction. An opening 89 may be formed through end wall 105, and opening 89 may be in fluid communication with ink chamber 73. An opening 104 may be formed through cylindrical wall 71B, above valve accommodating chamber 88, and adjacent to side wall 71A, and may be positioned above one or both of opening 89 and opening 87.

Main ink tank 70 may comprises two paths 91 and 92, each path extending between valve accommodating chamber 88 and ink chamber 73. Path 91 may extend from the lower portion of ink chamber 73 to valve accommodating chamber 88 in an X-axis direction, via opening 89. Path 92 may comprise a first vertical path 92A extending from valve accommodating chamber 88 in a Z-axis direction via opening 104, a horizontal path 92B extending from an end of first vertical path 92A in a Y-axis direction, and a second vertical path 92C extending from an end of horizontal path 92B in a Z-axis direction, bending at 90 degrees, then extending in X-axis direction, and reaching the upper portion of ink chamber 73 at an opening 94. In particular, path 92 may be in fluid communication with air layer 83, formed at the upper portion of ink chamber 73. Paths 91 and 92 may be defined by frame 71 and ribs formed on frame 71.

A buffer chamber 90 may be provided in path 92 and positioned directly above valve accommodating chamber 88. Buffer chamber 90 may have a cylindrical shape and may extend in a Y-axis direction. The cross sectional area of buffer chamber 90 taken in a plane perpendicular to the Y-axis direction may be greater than cross sectional areas of other portions of path 92, taken in the plane perpendicular to a direction in which ink flows in path 92. A check valve 93 may be provided at a middle portion of buffer chamber 90 in a Y-axis direction. Check valve 93 may be configured to be opened when the pressure in ink chamber 73 becomes lower than or equal to the pressure in valve accommodating chamber 88, and to be closed when the pressure in ink chamber 73 becomes greater than the pressure in valve accommodating chamber 88.

Referring again to FIGS. 7 and 8, a check valve 95 may be provided in path 91 at opening 89, and may be configured to be opened when the pressure in ink chamber 73 becomes greater than the pressure in valve accommodating chamber 88, and to be closed when the pressure in ink chamber 73 becomes lower than or equal to the pressure in valve accommodating chamber 88. Consequently, when ink flows into valve accommodating chamber 88 from the outside of ink cartridge 50, check valve 93 may be opened and check valve 95 may be closed because the pressure in ink chamber 73 becomes lower than the pressure in valve accommodating chamber 88. As a result, ink may flow from valve accommodating chamber 88 to the upper portion of ink chamber 73 via buffer chamber 90 and path 92. When air is supplied into ink chamber 73 from pump 170 as described later, check valve 93 may be closed and check valve 95 may be opened because the pressure in ink chamber 73 becomes higher than the pressure in valve accommodating chamber 88. As a result, ink flows from ink chamber 73 to valve accommodating chamber 88 via opening 89. Thus, a one-way path may be formed in main ink tank 70 as depicted by arrows 86 in FIG. 8.

Air bubbles may exist in valve accommodating chamber 88. Nevertheless, since opening 104 may be formed through cylindrical wall 71B above valve accommodating chamber 88, the buoyancy force acting on the air bubbles may move the air bubbles upward to buffer chamber 90, via opening 104. When check valve 93 is opened, the air bubbles may reach air layer 83 via check valve 93 and path 92. Even when check valve 93 is closed, the air bubbles may collect in buffer tank 90. When ink returns from tube 32 and sub ink tank 21 to main ink tank 70, air bubbles, which may have been trapped in tube 32 and sub ink tank 21, do not stay in valve accommodating chamber 88.

Main tank 70 may comprise an upper face 78, and a space 96 may be provided at upper face 78 to position pump 170 therein. A pump seat 98 may be formed on a wall defining the end of valve accommodating chamber 85. A pump seat 99 may be formed on upper face 78 adjacent to front face 79. Pump seats 98 and 99 may be formed integrally with frame 71. Pump 170 may be attached to main ink tank 70 at pump seats 98 and 99. Pump 170 may comprise a cylindrical tube 171, and the diameter of an opening 102, formed through pump seat 99 in the x direction, may be slightly greater than the outer diameter of cylindrical tube 171. Cylindrical tube 171 may comprise a front end 176 and a rear end 175 opposite front end 176. Cylindrical tube 171 may be inserted through opening 102, and rear end 175 may be attached to pump seat 99. Front end 176 of cylindrical tube 171 may be attached to pump seat 98. Cylindrical tube 171 may, have an inner surface defining an inner space 171A. Pump seat 98 may have an opening 103 formed therethrough, and inner space 171A and ink chamber 73 may be in fluid communication via opening 103. In another embodiment, pump 170 may comprise a square-pillar tube instead of cylindrical tube 171. In yet another embodiment, pump 170 may comprise a tube having any other shape, as long as the tube comprises a hollow body with two ends opposite each other.

Figure 8:
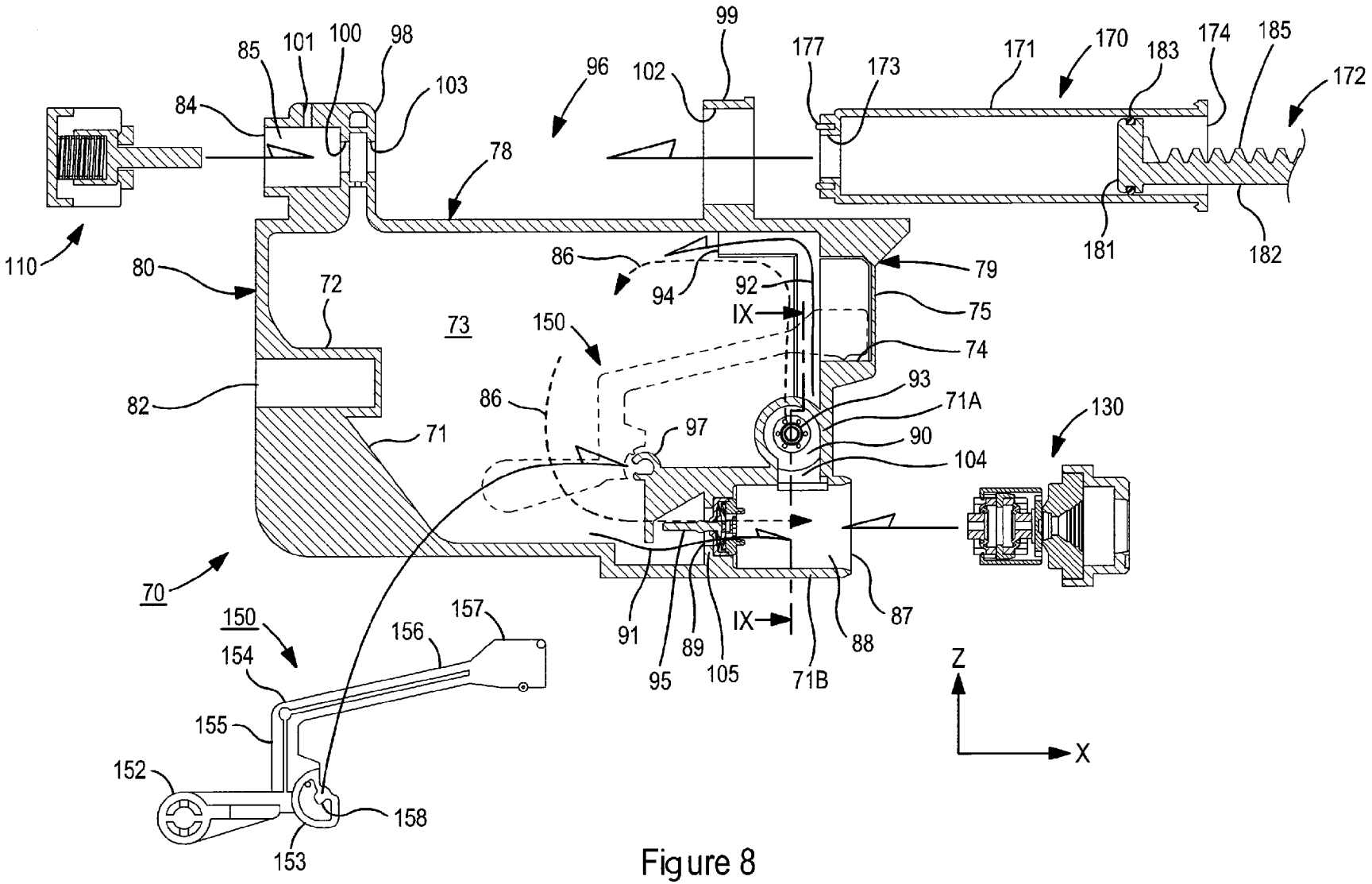
FIG. 8 is an exploded cross sectional view of the ink cartridge according to an embodiment of the invention.
Figure 9:
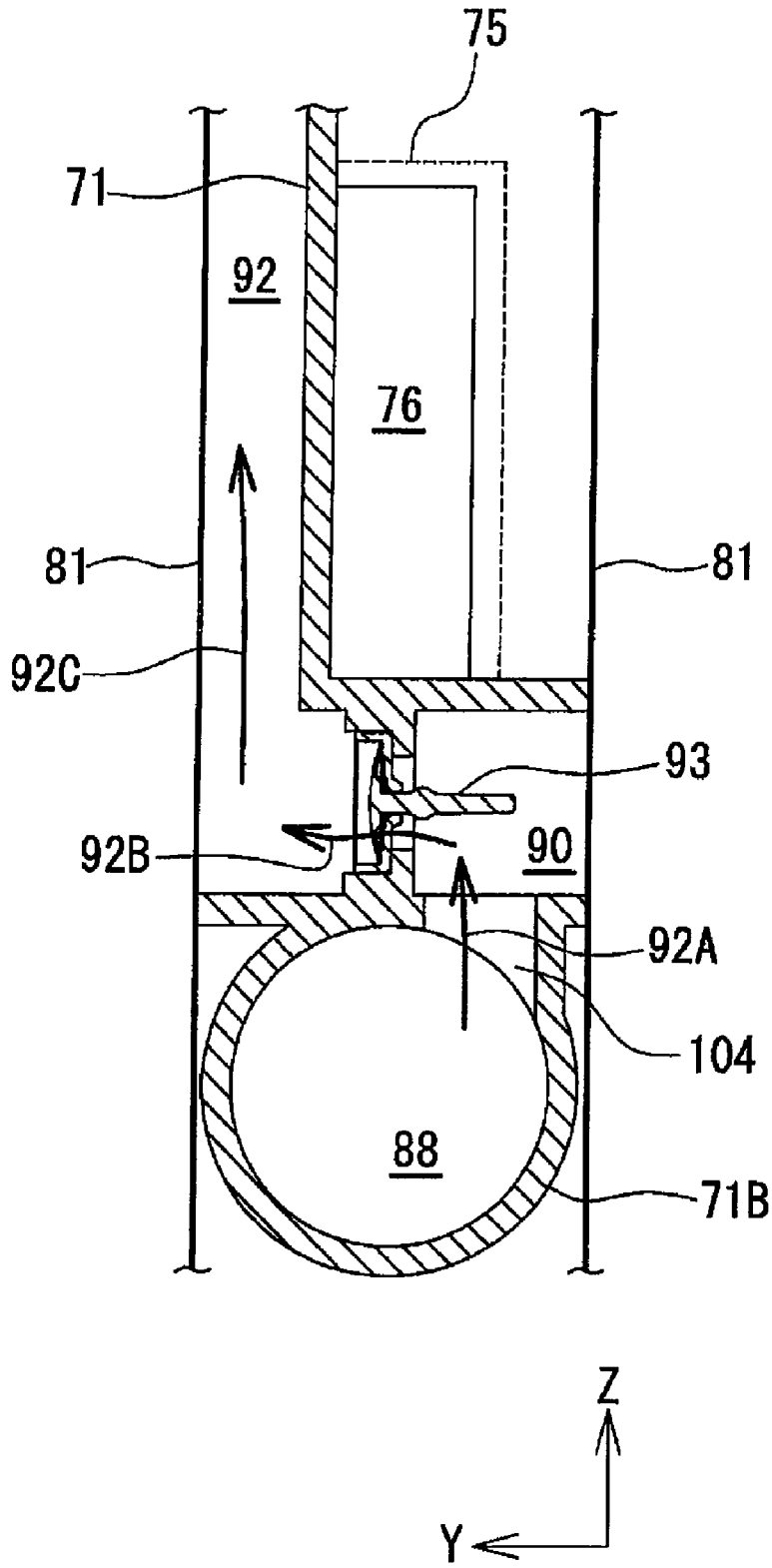
FIG. 9 is a partial cross sectional view taken along the IX-IX line in FIG. 8.

Referring to FIGS. 6 to 8, main ink tank 70 may comprise detection portion 75 extending from front face 79 of main ink tank 70 away from ink chamber 73 in the X-axis direction. Detection portion 75 may be integrally formed with frame 71, and detection portion 75 may comprise the same material as frame 71, e.g., at least one translucent synthetic resin. Detection portion 75 may be configured to allow light emitted from an optical sensor 203, described in more detail herein, to pass through. Detection portion 75 may comprise any transparent or semi-transparent material.

Referring again to FIGS. 7 to 9, detection portion 75 may comprise an inner space 76 formed therein. Inner space 76 may be in fluid communication with ink chamber 73. A sensor arm 150 may have a light blocking portion 157, at least a portion of which may be configured to move in and out of inner space 76. At least a portion of light blocking portion 157, may be configured to contact a support wall 74 which bounds the bottom of inner space 76, when a portion of light blocking portion 157 enters inner space 76, thus holding light blocking portion 157 at the position. At least a portion of light blocking portion 157 may be configured to be positioned at a particular position once it exits inner space 76.

Main ink tank 70 may comprise a support portion 97 formed integrally with frame 71 and configured to pivotally support sensor arm 150 and to grasp a shaft 158 of sensor arm 150. Sensor arm 150 may comprise at least one resin, e.g., a synthetic resin, and may be manufactured by injection molding. Sensor arm 150 may comprise a float portion 152, a connection portion 153 comprising shaft 158, and an arm portion 154. Float portion 152 may extend from connection portion 153 in a direction perpendicular to a direction in which shaft 158 extends. The specific gravity of float portion 152 may be less than or equal to the specific gravity of ink stored in ink chamber 73. Float portion 152 therefore may be configured to float on ink if the movement of float portion 152 is not restricted. Float portion 152 may comprise a hollow space formed therein, or may comprise a solid material whose specific gravity is less than the specific gravity of ink.

Arm portion 154 may comprise a first arm 155, a second arm 156, and light blocking portion 157. First arm 155 may extend from connection portion 153 in a direction perpendicular to the direction in which float portion 152 extends. Second arm 156 may extend from first arm 155 in a direction away from float portion 152. Light blocking portion 157 may be connected to an end of second arm 156. Arm portion 154 may have less mass than float portion 152. As shown in FIG. 7, sensor arm 150 may be configured to pivot around shaft 158 in the counterclockwise direction 162 when ink chamber 76 is empty of ink, and at least a portion of light blocking member 157 may be configured to go out of inner space 76 of detection portion 75, because the float portion 152 may be heavier than the arm portion 154. Float portion 152 may comprise a bottom end, and ink chamber 73 may comprise a bottom inner wall surface. When the bottom end of float portion 152 contacts the bottom inner wall surface of ink chamber 73, sensor arm 150 may be configured to stop pivoting, and light blocking portion 157 may be positioned as shown in FIG. 7.

Referring to FIG. 10, when ink tank 76 is filled with the predetermined amount of ink, the entirely of sensor arm 150 may be submerged in ink. In this state, the buoyancy force acting on float portion 152 may be greater than the buoyancy acting on arm portion 154, and the buoyancy force acting on float portion 152 may be great enough to pivot sensor arm 150 around shaft 158 in the clockwise direction 163 as shown in FIG. 10, even though float portion 152 may have a greater mass than the arm portion 154. Light blocking portion 157 may be configured to enter into inner space 76 of detection portion 75, in accordance with the pivot of sensor arm 150. Sensor arm 150 may be configured to stop pivoting when light blocking portion 157 contacts support wall 74.

Figure 11:
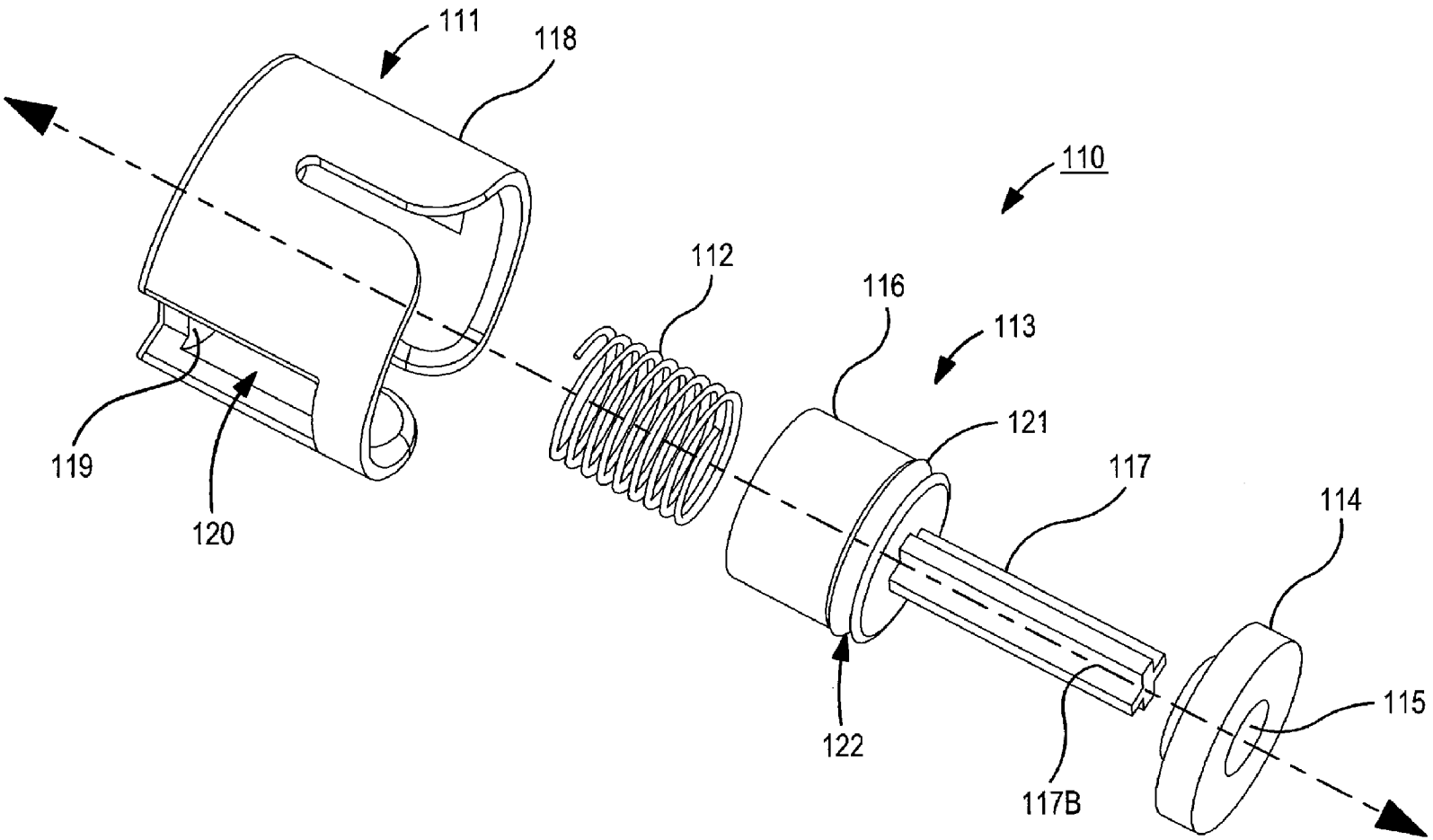
FIG. 11 is an exploded view of an air communication portion, according to an embodiment of the invention.
Figure 12:
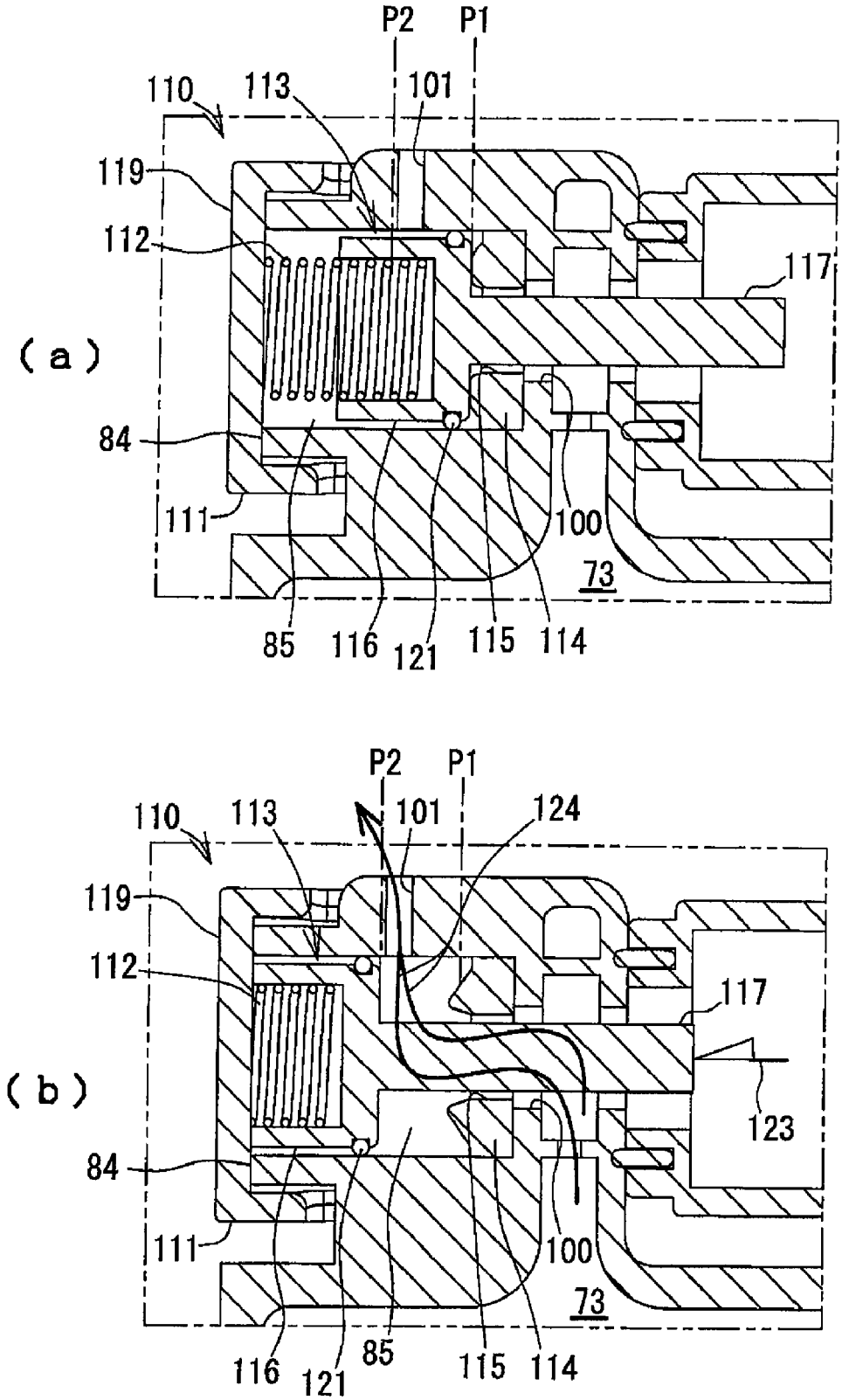
FIG. 12(*a*) is a partial cross sectional view of the air communication portion when a valve is positioned at P1.

Referring to FIGS. 10 to 12, air communication portion 110 may be configured to allow fluid communication between the atmosphere and air layer 83 via opening 101. Air communication portion may comprise a cap 111, coil spring 112, valve 113, and valve seat 114. Cap 111, coil spring 112, valve 113, and valve seat 114 may be aligned in this order in an X-axis direction. Coil spring 112, valve 113, and vale seat 114 may be accommodated in valve accommodating chamber 85, and cap 111 may be attached to the surrounding area of opening 84.

Coil spring 112 may urge valve 113 towards valve seat 114 in an X-axis direction. Coil spring 112 may comprise a metal material or a resin material. Coil spring 112 may be accommodated in valve accommodating chamber 85 in a compressed state, and may be generating a force in a direction in which coil spring 112 expands. Coil spring 112 may be replaced with any urging member, e.g., a leaf spring, which urges valve 113 towards valve seat 114.

Cap 111 may comprise a circular end wall 119 and a cylindrical side wall 118 extending from the outer edge of end wall 119. End wall 119 may contact coil spring 112. Two slots 120 may be formed through side wall 118, and two ribs may be formed on the surrounding area of opening 84, and inserted into slots 120. Cap 111 may be attached to the surrounding are of opening 84.

Valve 113 may comprise piston 116, and rod 117 may be integrally formed with piston 116, which may contact coil spring 112. Piston 116 may be urged toward valve seat 114 in an X-axis direction. A circular groove 122 may be formed in the peripheral wall of piston 116, and an elastic O-ring 121 may be fitted in groove 122. The outer diameter of O-ring 121 may be greater than the outer diameter of the peripheral wall of piston 116. Valve 113 may be configured to slide inside valve accommodating chamber 85, with O-ring 121 contacting the wall surface of valve accommodating chamber 85, while preventing fluid communication between the coil spring 112 side of piston 116 and the rod 117 side of piston 116.

Valve seat 114 may be configured to contact piston 116, urged by coil spring 112 in the X-axis direction, and may be positioned at the end of valve accommodating chamber 85. Valve seat 114 may have an annular shape with an opening 115 formed through the center thereof. The center of opening 115 may be aligned with the center of opening 100, formed at the end of valve accommodating chamber 85. A portion of rod 117 may be positioned in opening 115. Valve seat 114 may comprise an elastic material, e.g. rubber, allowing valve seat 114 and piston 116 urged by coil spring 112 to contact tightly without a gap therebetween.

Referring to FIG. 12(*a*), when an external force is not applied to rod 117, valve 113 may be urged by coil spring 112, and may be positioned at a position P1, at which piston 116 contacts valve seat 114. Piston 116 and valve seat 114 may contact tightly, and valve seat 114 and the end of valve accommodating chamber 85 may contact tightly. In this state, communication between ink chamber 73 and valve accommodating chamber 85 via openings 100 and 115 may be prevented.

Referring to FIG. 12(*b*), when an external force, which may be greater than the urging force of coil spring 112, is applied to rod 117 in a direction 123, valve 113 may move against the urging force of coil spring 112 in direction 123, and piston 116 may separate away from valve seat 114. Valve 113 may move to a position P2, at which position piston 116 may contact end wall 119 of cap 111. In this state, fluid communication between the atmosphere and ink chamber 73 may be established via opening 100, opening 115, valve accommodating chamber 85, and opening 101 as indicated by arrows 124. The external force may be applied by a piston 181 when a plunger 172 is pushed into an end of cylindrical tube 171, and piston 181 may push rod 117 as described below.

Pump 170 may be configured to supply air to air layer 83, formed in ink chamber 73, and to draw air from air layer 83. When air is supplied to air layer 83, the air pressure of air layer 83 may increase, which may cause ink stored in ink chamber 73 to flow out of ink chamber 73. As a result, the volume of air layer 83 may increase. When air is drawn from air layer 83, the air pressure of air layer 83 decreases, which may causes ink to flow into ink chamber 73. As a result, the volume of air layer 83 may decrease.

Figure 13:
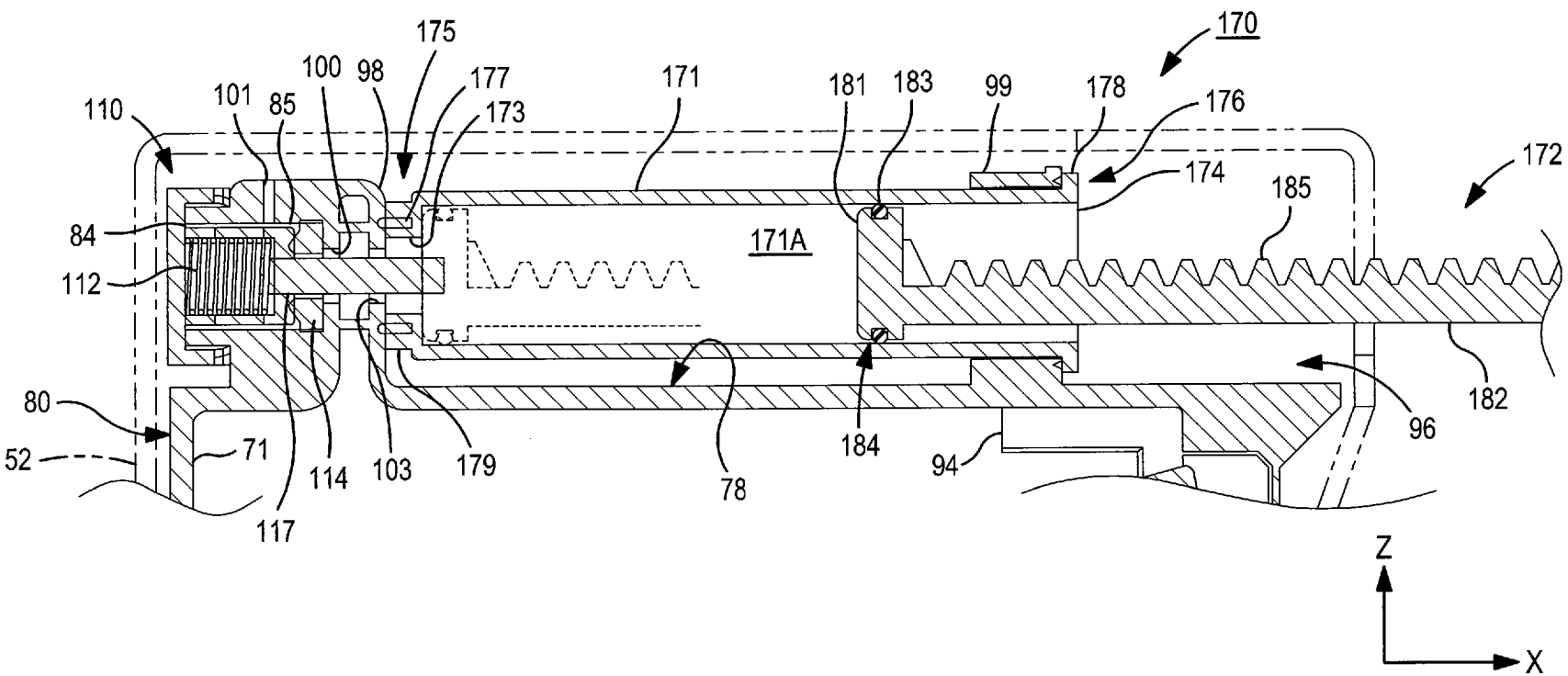
FIG. 13 is a partial cross sectional view of a pump, according to an embodiment of the invention.

Referring to FIG. 13, pump 170 may comprise cylindrical tube 171 and plunger 172, each of which may comprise at least one synthetic resin, and may be manufactured by injection molding. Cylindrical tube 171 may be attached to upper face 78 of main ink tank 70. Cylindrical tube 171 may have a central axis extending between front end 176 and rear end 175, and the central axis of cylindrical tube 171 may be parallel with an X-axis direction. Cylindrical tube 171 may have an opening 174 at front end 176 thereof adjacent to front face 79 of main ink tank 70. Plunger 172 may be inserted into inner space 171A of cylindrical tube 171 through opening 174. Cylindrical tube 171 may comprise an end wall 179 at rear end 175 thereof, contacting pump seat 98. An opening 173 may be formed through end wall 179. Air in inner space 171A may flows into and out of ink chamber 73 via opening 173.

An annular attachment member 177 may be provided at rear end 175.A portion of attachment member 177 may be buried in end wall 179, and the other portion of attachment member 177 may extend from rear end 175 in the axial direction of cylindrical tube 171. Pump seat 98 may have an annular groove formed therein, and the extending portion of attachment member 177 may be fitted in the groove of pump seat 98. Rear end 175 of cylindrical tube 171 may thus be attached to pump seat 98. Attachment member 177 may be coated with a rubber material, and therefore attachment member 177 and pump seat 98 may contact tightly without a gap therebetween. As a result, an air path between inner space 171A of cylindrical tube 171 and ink chamber 73 may be air-tightly sealed so that air may not leak from the air path and air may not enter into the air path from the atmosphere.

Cylindrical tube 171 may comprise a flange 178 at front end 176, and flange 178 may extend from cylindrical tube 171 in the radial direction of cylindrical tube 171. Rear end 175 of cylindrical tube 171 may be inserted into opening 102 of pump seat 99, and when front end 176 of cylindrical tube 171 reaches pump seat 99, flange 178 may contact the surrounding area of opening 102. Plunger 172 may comprise piston 181 and a rod 182, which may be integrally formed. A circular groove 184 may be formed in the peripheral wall of piston 181, and an elastic O-ring 183 may be fitted in groove 184. The outer diameter of O-ring 184 may be greater than the outer diameter of the peripheral surface of piston 181. Piston 181 may be configured to slide within inner space 171A with O-ring 184 contacting the inner surface of cylindrical tube 171, while preventing air communication between the front-end 176 side of piston 181 and the rear-end 175 side of piston 181. In another embodiment, O-ring 183 may be omitted, and the peripheral surface of piston 181 may be coated with an elastic material, and piston 181 may be configured to slide on the inner surface of cylindrical tube 171 with the peripheral surface of piston 181 contacting the inner surface of cylindrical tube 171 while preventing fluid communication between the front-end 176 side of piston 181 and the rear-end 175 side of piston 181.

A rack gear 185 may be formed on the upper surface of rod 182. Rack gear 185 may be configured to engage with a pinion gear 221, which will be described in more detail herein. A driving force thus may be transferred to piston 181 via rod 182, to slide piston 181 in the axial direction of cylindrical tube 171. When piston 181 slides towards rear face 80 of main ink tank 70 in X-axis direction, the volume of inner space 171A of cylindrical tube 171 may decrease. Air corresponding to the decrease of the volume of inner space 171A may be supplied to air layer 83 formed in ink chamber 73 via openings 173 and 103. When piston 181 slides towards front face 79 of main ink tank 70 in an X-axis direction, the volume of inner space 171A of cylindrical tube 171 may increase. Air may be drawn from air layer 83 into inner space 171A via openings 173 and 103.

The capacity of pump 170 may be equal to or greater than the total capacity of the capacity of sub ink tank 21 and the capacity of tube 32. The capacity of pump 170 may be determined by the cross sectional area of inner space 171A of cylindrical tube 171, and also by the moving range of piston 181. Cylindrical tube 171 may have the cross sectional area and the length which allows the capacity of pump 170 to be equal to or greater than the total capacity of sub ink tank 21 and the capacity of tube 32. The moving range of piston 181 may be predetermined by a driving mechanism 200, which is described in more detail herein. Pump 170 may be configured to supply a predetermined amount of air into ink chamber 73, and may draw the predetermined amount of air from ink chamber 73.

Figure 14:
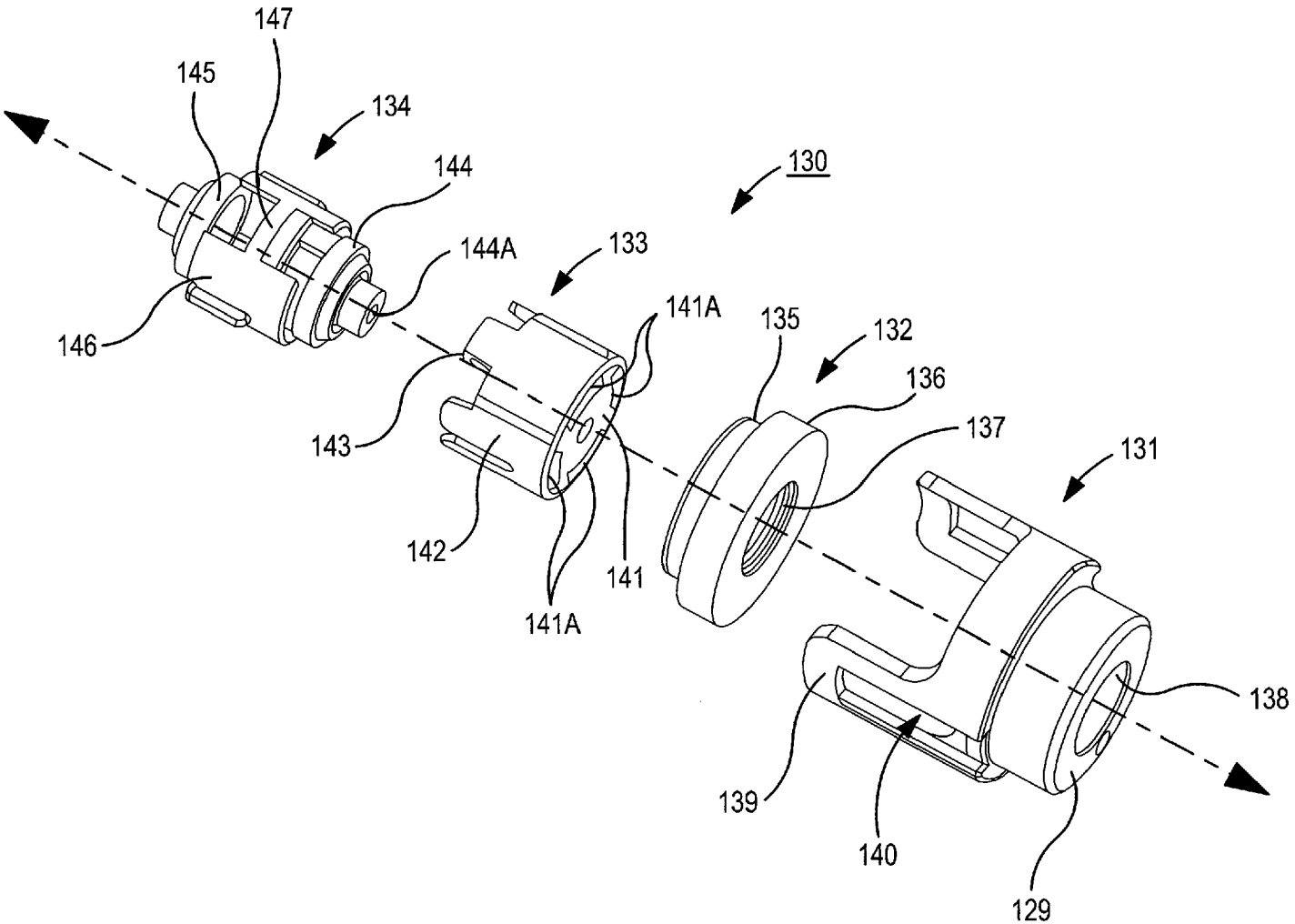
FIG. 14 is an exploded view of an ink supply portion, according to an embodiment of the invention.
Figure 15:
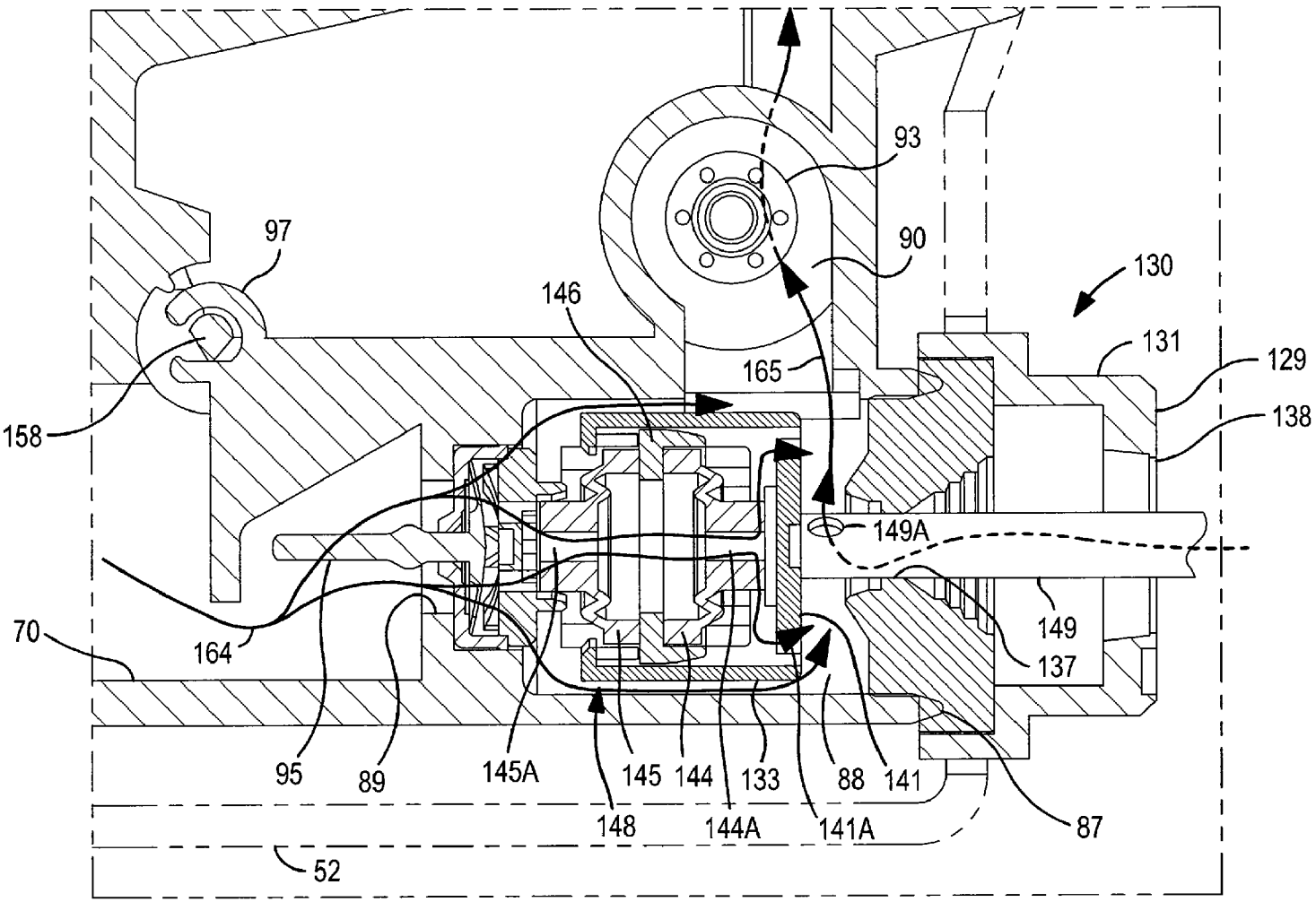
FIG. 15 is a partial cross sectional view of the ink supply portion, according to an embodiment of the invention.
Figure 16:
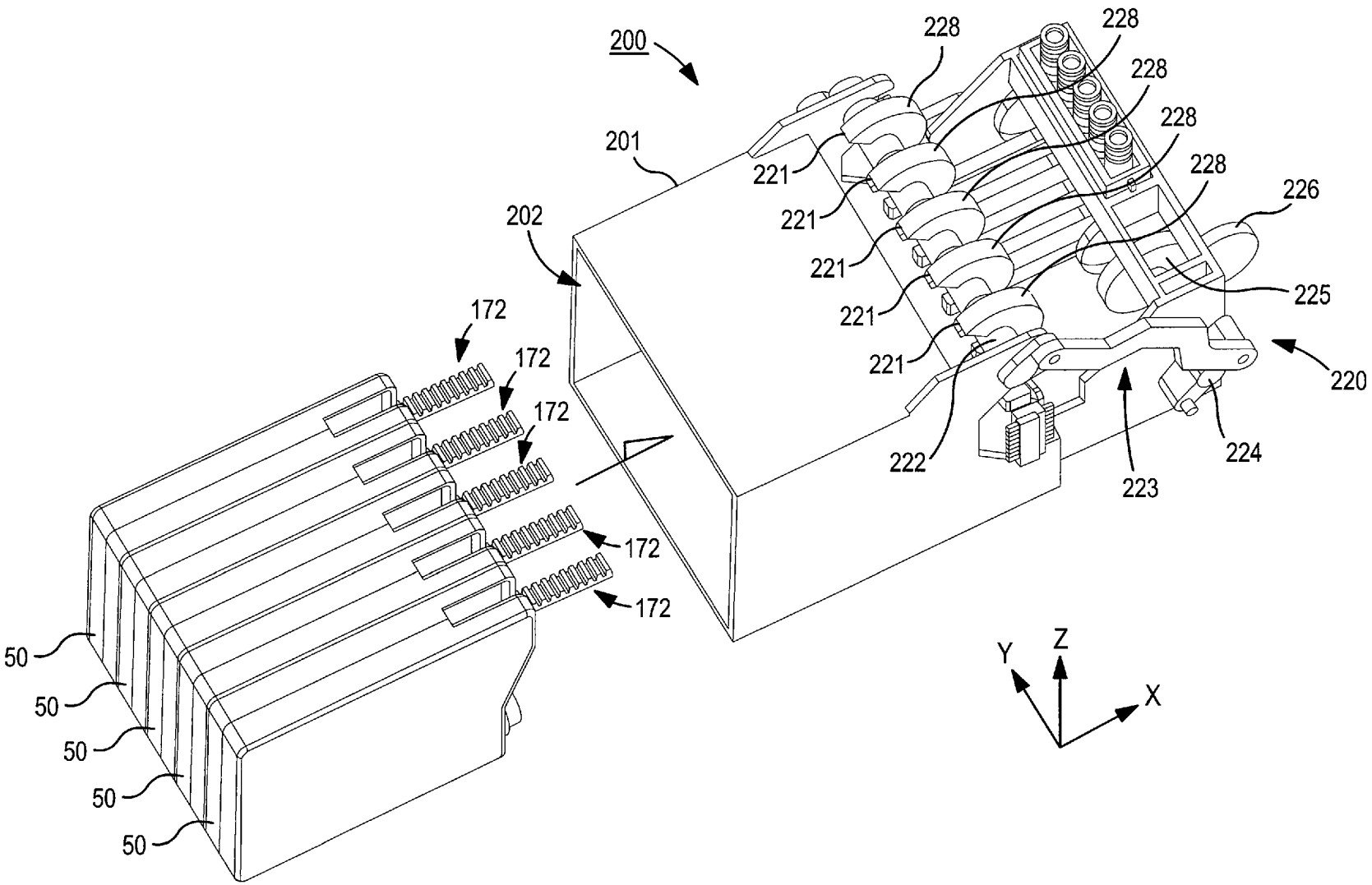
FIG. 16 is a perspective view of a cartridge mounting portion and the ink cartridges when the ink cartridges are not mounted to the cartridge mounting portion, according to an embodiment of the invention.
Figure 17:
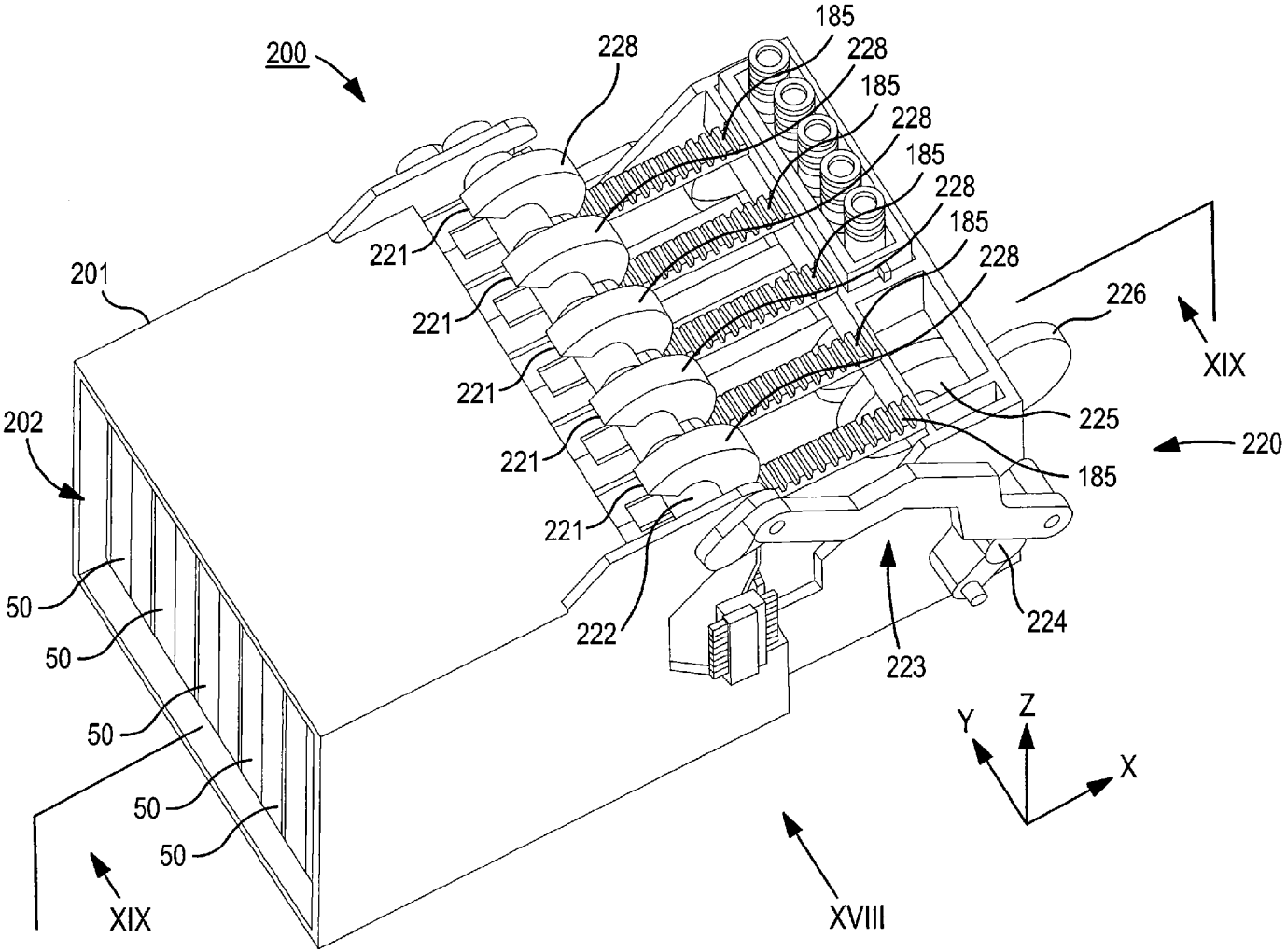
FIG. 17 is a perspective view of the cartridge mounting portion and the ink cartridges when the ink cartridges are mounted to the cartridge mounting portion, according to an embodiment of the invention.
Figure 18:
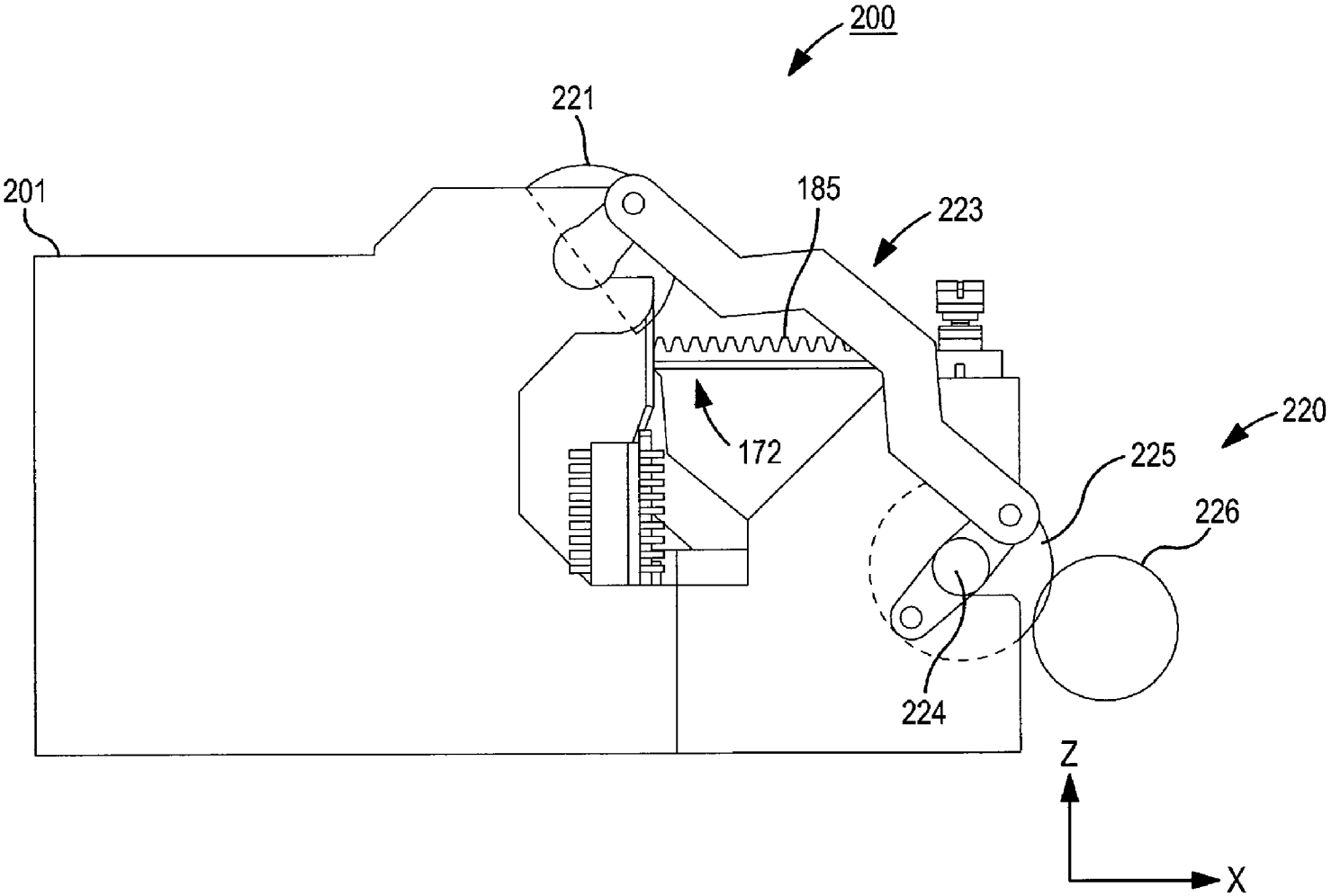
FIG. 18 is a side view of the cartridge mounting portion seen along an arrow XVIII in FIG. 17.
Figure 19:
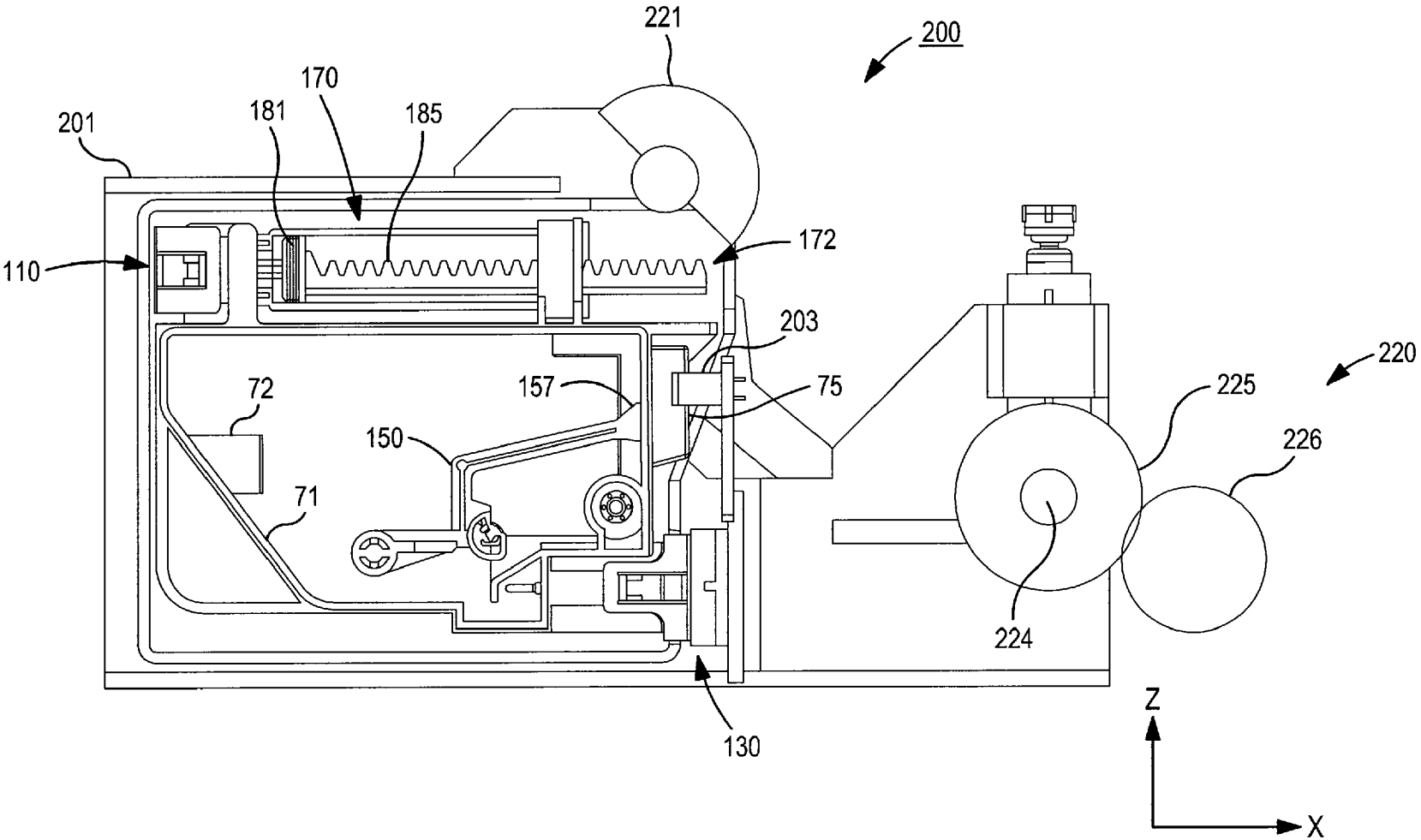
FIG. 19 is a cross sectional view of the cartridge mounting portion and the ink cartridge taken along XIX-XIX line in FIG. 17.

Ink supply portion 130 may be configured to supply ink in ink chamber 73 to the outside of ink cartridge 50, and may be connected to tube 32. Referring now to FIGS. 14 and 15, ink supply portion 130 may comprise a cap 131, a joint 132, valve 133, and spring unit 134. Cap 131, joint 132, valve 133, and spring unit 134 may be aligned in this order in an X-axis direction. Valve 133 and spring unit 134 may be accommodated within valve accommodating chamber 88. A portion of joint 132 may be fitted into opening 87 from the outside of valve accommodating chamber 88. Cap 131 may be attached to the surrounding area of opening 87 via joint 132, which may comprise an elastic synthetic resin. Joint 132 may have an annular shape with an opening 137 formed through the center thereof.

Joint 132 may comprise a first cylindrical portion 135 and a second cylindrical portion 136. First cylindrical portion 135 may be fitted into opening 87 and second cylindrical portion 136 may contact the surrounding portion of opening 87. A rigid tube 149 may be connected to an end of tube 32. Tube 149 may be configured to be inserted through opening 137 when ink cartridge 50 is mounted to cartridge mounting portion 200. The diameter of opening 137 may be slightly smaller than the outer diameter of tube 149. Consequently, when tube 149 is inserted through opening 137, the outer surface of tube 149 may press the inner surface of joint 132, defining opening 137, and the outer surface of tube 149 and the inner surface of joint 132 may contact tightly, which may prevent ink leakage between tube 149 and joint 132.

Cap 131 may comprise a circular end wall 129 and a side wall 139 extending from the outer edge of end wall 129. End wall 129 may have an opening 138 formed therethrough. Two slots 140 may be formed through side wall 139. Two ribs are formed on the surrounding area of opening 87, and the ribs may be inserted into slots 140. Cap 131 may be attached to the surrounding area of opening 87. Spring unit 134 may be configured to urge valve 133 towards joint 132 in an X-axis direction. Spring unit 134 may comprise a first spring 144, a second spring 145, and a slider 146. Each of first spring 144 and second spring 145 may comprise an elastic resin material, and may have an indented, rounded shape, e.g., a bowl shape, or a hollow circular conic shape. When a load is applied to first spring 144 or second spring 145, the side surface thereof may be elastically deformed.

First spring 144 and second spring 145 may have an opening 144A and an opening 145A formed therethrough. As shown in FIG. 15, ink may flow through the inside of first spring 144 and second spring 145 via openings 144A and 145A, as indicated by arrows 164. Slider 146 may comprise two accommodating chambers, accommodating first spring 144 and second spring 145 therein, respectively.

Spring unit 134 may be accommodated in valve accommodating chamber 88 in a compressed state and may generate a force in a direction to causing spring unit 134 to expand. End wall 105 may contact and support spring unit 134. Slider 146 may comprise ribs 147 for coupling valve 133, and valve unit 134. Valve 133 may comprise claws 143, configured to engage with ribs 147. Any member may be used instead of valve unit 134, as long as it urges valve 133 towards joint 132.

Valve 133 may comprise a circular end wall 141 and a cylindrical side wall 142, extending from the outer edge of end wall 141. End wall 141 may have a plurality of openings 141A formed therethrough, and openings 141A may be aligned in the circumferential direction of end wall 141. End wall 141 contacts first spring 144. Side wall 142 may comprise claws 143. Valve 133 and spring unit 134 may be coupled by the engagement between claws 143 and ribs 147. Valve accommodating chamber 88 may comprise a cylindrical wall surface extending from opening 87 to the end of the valve accommodating chamber 88. Valve 133 may be configured to slide within valve accommodating chamber 88 in an X-axis direction, with a gap 148 between side wall 142 and the wall surface of valve accommodating chamber 85, and ink may flow through gap 148.

When tube 149 is inserted into valve accommodating chamber 88 via openings 138 and 137, an end of tube 149 may contact end wall 141 of valve 133 and press valve 133 against the urging force of spring unit 134. Valve 133 may move toward ink chamber 73, and end wall 141 may separate from joint 132. Tube 149 may have an opening 149A formed therethrough, adjacent to the end of tube 149. When end wall 141 separates from joint 132, fluid communication between valve accommodating chamber 88 and the inside of tube 149, via opening 149A, may be established.

Referring again to FIG. 15, when ink is supplied from ink chamber 73 to sub ink tank 21, ink may enter into valve accommodating chamber 88 via check valve 95, and then the ink may flow through gap 148, or flow through spring unit 134 and openings 141A, as indicated by arrows 164. When ink is drawn from sub ink tank 21 to ink chamber 73, ink may flow into valve accommodating chamber 88 via opening 149A, and then the ink may flow via buffer chamber 90, check valve 93, and path 92, to reach air layer 83.

Referring now to FIGS. 16 to 19, cartridge mounting portion 200 may be configured to mount at least one ink cartridge 50. In an embodiment, cartridge mounting portion 200 may mount a plurality of, e.g., five, ink cartridges 50 storing cyan ink, magenta ink, yellow ink, dye-based black ink, and pigment-based black ink, respectively. Cartridge mounting portion 200 may comprise a cartridge case 201 having an opening 202 on one side, and a closed end opposite the opening 202. Ink cartridge 50 may be inserted into cartridge case 201 through opening 202. When ink cartridge 50 is inserted into cartridge case 201, and ink cartridge 50 is pressed in an X-axis direction, tube 149, provided at the closed end of cartridge case 201, may enter into ink supply portion 130. After ink stored in ink chamber 73 is consumed, ink cartridge 50 may be removed from cartridge case 201 to be replaced with a new ink cartridge 50.

At least one optical sensor 203, e.g. a photo interrupter, may be provided at the closed end of cartridge 201. Optical sensor 203 may comprise a light emitting portion and a light receiving portion. Optical sensor 203 may be configured to output a predetermined signal to the main controller of inkjet recording device 10, based on the intensity of light received by the light receiving portion. A plurality of, e.g., five optical sensors 203 may be provided for the plurality of, e.g., five, ink cartridges 50, respectively. Optical sensor 203 may be positioned such that detection portion 75 is positioned between the light emitting portion and the light receiving portion when the ink cartridge 50 is mounted to cartridge mounting portion 200.

When light blocking portion 157 is in detection portion 75, light blocking portion 157 may block light emitted from the light emitting portion. When light blocking portion 157 is not in detection portion 75, light emitted from the light emitting portion may reach the light receiving portion unhindered. Based on the intensity of light received by the light receiving potion, the amount of ink remaining in ink cartridge 50 may be determined.

Driving mechanism 220 may be provided behind cartridge mounting portion 200. Driving mechanism 200 may comprise at least one pinion gear 221, a shaft 222, a link rod 223, a shaft 224, a first gear 225, and a second gear 226. A plurality of, e.g., five pinion gears 221 may be provided, corresponding to the plurality of, e.g., five ink cartridges 50. Pinion gear 221 may be configured to engage with rack gear 185 when ink cartridge 50 is mounted to cartridge mounting portion 200. Pinion gear 221 may have a semi-circular shape, and the teeth may be formed on the arc portion of pinion gear 221. A plurality of, e.g., five pinion gears 221 may be fixed to shaft 222. When shaft 222 rotates, all the pinion gears 221 may rotate in the same direction in which shaft 222 rotates, and at the same speed at which shaft 222 rotates. Link rod 223 may be coupled to one end of shaft 222 at one end thereof, and may be coupled to shaft 224 at the other end thereof. First gear 225 may be fixed to shaft 224, and second gear 226 may engage with first gear 225.

Second gear 226 may be coupled to a driving source, e.g. a motor. Paper feed device 12 and convey device 13 may be coupled to the same driving source, which may be controlled by the main controller of inkjet recording device 10. When a driving force is transferred to second gear 226 from the driving source, the driving force also may be transferred to rack gear 185 via first gear 225, shaft 224, link rod 223, shaft 222, and pinion gear 221. Thus, piston 181 may be configured to slide back and forth within cylindrical tube 171.

Figure 20:
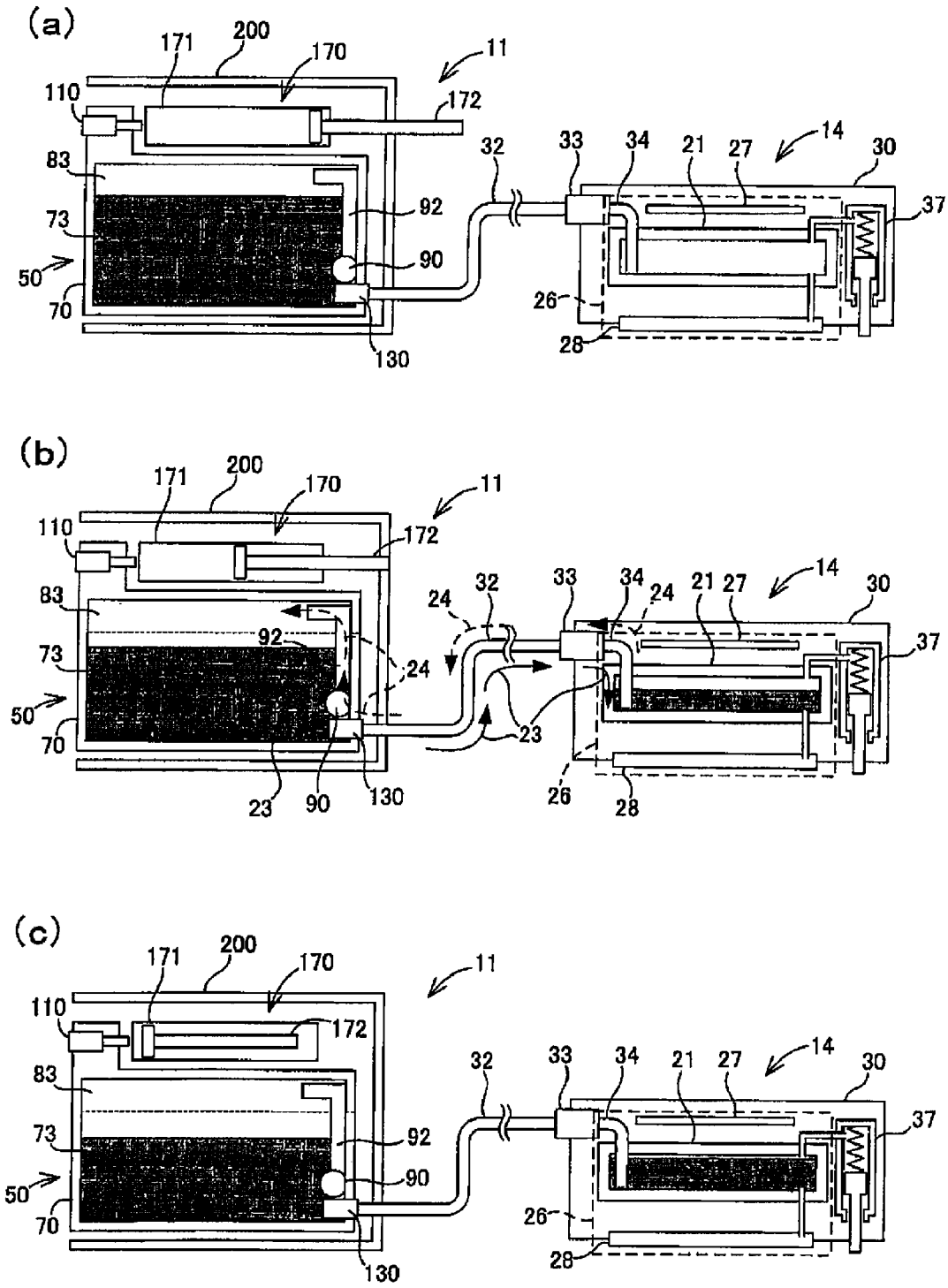
FIGS. 20(*a*) to 20(*c*) are schematics depicting an ink supply process and an ink draw process.

FIGS. 20(*a*) to 20(*c*) show an ink supply process from main ink tank 70 to sub ink tank 21 by an ink supply system 11 according to an embodiment. During the ink supply process, opening 42 formed at cylinder 39 of valve mechanism 37 may be opened as described above.

Referring to FIG. 20(*a*), when plunger 172 is moved towards rear face 80 of main ink tank 70 from a state in which plunger 172 is positioned as far out of cylindrical tube 171 as its range of motion may allow, air in cylindrical tube 171 may be supplied to air layer 83 formed in ink chamber 73, via openings 173 and 103. As a result, the pressure in ink chamber 73 may increase. Referring to FIG. 20(*b*), when the pressure in ink chamber 73 becomes higher than the pressure in valve accommodating chamber 88, check valve 95 may be opened, and ink stored in ink chamber 73 may flow into valve accommodating chamber 88, via opening 89. The ink then may flow into tube 32 and may be supplied to sub ink tank 21 as indicated by arrows 23. As a result, the volume of air layer 83 may increase. Referring to FIG. 20(*c*), when plunger 172 may be moved to the end of cylindrical tube 171, sub ink tank 21 and tube 32 may be filled with ink.

Referring to FIG. 20(*c*), when plunger 172 is moved back towards front face 79 of main ink tank 70 from a state in which plunger 172 is pushed into cylindrical tube 171 as far as plunger 172's range of motion may allow, air may be drawn from air layer 83 into cylindrical tube 171 via openings 103 and 173. As a result, the pressure in ink chamber 73 may decrease. Referring to FIG. 20(*b*), when the pressure in ink chamber 73 becomes lower than the pressure in valve accommodating chamber 88, check valve 93 may be opened, and ink stored in sub ink tank 21 and tube 32 may flow into main ink tank 70 as indicated by arrows 24. More specifically, ink in valve accommodating chamber 88 may flow into ink chamber 73 via path 92. This may cause ink in sub ink tank 21 to flow into valve accommodating chamber 88 via tube 32, which may result in a decrease in the volume of air layer 83. Referring again to FIG. 20(*a*), when plunger 172 is positioned as far out of cylindrical tube 171 as its range of motion may allow, the ink in tube 32 and sub ink tank 21 may be completely drawn into main ink tank 70.

During the process in which ink is drawn into ink chamber 73 of main ink tank 70, air bubbles trapped in ink tube 32 or sub ink tank 21 also may be drawn into ink chamber 73. More specifically, the air bubbles may flow via path 92 to skirt around sensor arm 150, and may reach air layer 83 formed in the upper potion of ink chamber 73, allowing the trapped air bubbles to be separated from ink. After that, ink not containing air bubbles may be supplied to sub ink tank 21 via tube 32. Consequently, ink in sub ink tank 21 may be replaced with ink in main ink tank 70, and ink in sub ink tank 21 and ink in main ink tank 70 may be mixed. Thus, the viscosity of ink may be equalized by the mixture.

Some of the air bubbles may be left in valve accommodating chamber 88 during the process in which ink is drawn into ink chamber 73 of main ink tank 70. Nevertheless, since opening 104 may be formed through cylindrical wall 71B above valve accommodating chamber 88, the buoyancy force acting on the air bubbles may move the air bubbles to buffer chamber 90 via opening 104. When check valve 93 is opened, the air bubbles may reach air layer 83 via check valve 93 and path 92. Even when check valve 93 is closed, the air bubbles may be collected in buffer tank 90. Consequently, the air bubbles may not stay in valve accommodating chamber 88.

The ink and the air bubbles returning from sub ink tank 21 to main ink tank 70 via tube 21 may flow in path 92 and may reach air layer 83 formed in the upper potion of ink chamber 73. Therefore the ink and the air bubbles may move around sensor arm 150, and the air bubbles may be prevented from adhering to sensor arm 150, and may be prevented from disturbing the movement of sensor arm 150. Tube 32 may be omitted, and main ink tank 70 and sub ink tank 21 may be directly coupled when carriage 30 is in a predetermined position. Ink may be supplied from main ink tank 70 to sub ink tank 21 and drawn from sub ink tank 21 to main ink tank 70 without entering into pump 170. Even if pump 170 breaks, ink thus may not leak from pump 170. In the event that pump 170 breaks, pump 170 easily may be replaced with a new pump by only replacing ink cartridge 50 with a new pump. Moreover, ink cartridge 50 may be replaced when the ink in ink cartridge 50 runs out, and therefore pump 170 may be replaced before pump 170 breaks or begins to decline in.

Tube 32 may define a non-circulating path extending from pump 170 to sub ink tank 21 via ink chamber 73. Since ink may be supplied from main ink tank 70 to sub ink tank 21 and drawn from sub ink tank 21 to main ink tank 70 with only one tube 32 defining the non-circulating path, the number of tubes may be reduced.

Pump 170 is a kind of a piston pump. However, in other embodiments, any type of pump may be used, e.g., a plunger pump, a diaphragm pump, a wing pump, or a combination of any pump with a driving mechanism. Rod 182 may be configured to extend from front face 60 of case 52 of ink cartridge 50, allowing access to ink cartridge 50 from the rear face of case 52.

Opening 87 may have a center line perpendicular to side wall 71A. Valve 133 may be configured to move along the center line of opening 87, and spring unit 134 may urge the valve along the center line. When tube 149 is inserted through opening 87 along the center line, valve 133 may move along the center line against the urging force of spring unit 134. When tube 149 is removed, valve 133 may move by spring unit 134 along the center line.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink cartridge comprising:

an ink chamber configured to store ink therein, wherein the ink chamber is defined by at least one wall, and an air layer is formed in the ink chamber between a surface of the ink and at least a portion of the at least one wall; and a pump configured to selectively supply air to the air layer and to draw air from the air layer, the pump comprising:

at least one wall which defines an air space therein, and the air space is in fluid communication with the air layer, wherein the pump is configured to change a volume of the air space;

a tube, the tube having:

an inner space formed therethrough by an inner surface of the tube;

a first end; and a second end opposite the first end, wherein the inner space is configured to be in fluid communication with the ink chamber via the first end, and the inner space is configured to be in fluid communication with an atmosphere via the second end; and a movable member positioned in the inner space and configured to selectively move in the inner space in a first direction such that the air space decreases and in a second direction opposite the first direction such that the air space increases, wherein a portion of the movable member contacts the inner surface of the tube, and the movable member prevents fluid communication between the ink chamber and the atmosphere via the movable member regardless of whether the movable member moves in the first direction or the second direction.

2. The ink cartridge of claim 1, wherein the pump is configured to selectively supply a predetermined amount of air to the air layer and to draw the predetermined amount of air from the air layer.

3. The ink cartridge of claim 1, further comprising a rod extending from the movable member to an outside of the tube through the second end.

4. The ink cartridge of claim 3, wherein the rod comprises a rack gear formed thereon.

5. The ink cartridge of claim 4, further comprising:

a front face; and an ink supply portion positioned at the front face, wherein the rod is configured to extend from the front face.

6. The ink cartridge of claim 1, further comprising an ink tank comprising the at least one wall defining the ink chamber therein, wherein the ink tank has a height in a height direction, a width in a width direction, and a depth in a depth direction, the width direction being perpendicular to the height direction, and the depth direction being perpendicular to each of the height direction and the width direction, wherein the height is greater than the width, and the depth is greater than the height.

7. The ink cartridge of claim 6, wherein the tube extends from the first end to the second end in the depth direction.

8. The ink cartridge of claim 1, further comprising an air communication valve positioned adjacent to the ink chamber, and configured to selectively allow or prevent a communication between the ink chamber and the atmosphere therethrough.

9. The ink cartridge of claim 8, wherein the air communication valve is actuated by the movable member.

10. The ink cartridge of claim 1, wherein the movable member comprises:

a piston comprising a peripheral wall facing the inner surface of the tube, the peripheral wall having a groove formed therein, and an elastic member fitted in the groove, the elastic member contacting the inner surface of the tube.

11. An ink supply system comprising:

a first ink tank comprising:

an ink chamber configured to store ink therein, wherein the ink chamber is defined by at least one wall, and an air layer is formed in the ink chamber between a surface of the ink and at least a portion of the at least one wall; and a pump configured to selectively supply air to the air layer and to draw air from the air layer; and a second ink tank configured to store ink, wherein the first ink tank and the second ink tank are configured to be in fluid communication with each other, and the first ink tank and the second ink tank are configured such that ink flows from the ink chamber to the second ink tank when air is supplied to the air layer and ink flows from the second ink tank to the ink chamber when air is drawn from the air layer.

12. The ink supply system of claim 11, further comprising a tube connected to the first ink tank and to the second ink tank, wherein the tube defines a non-circulating path extending from the pump to the second ink tank via the ink chamber.

13. The ink cartridge of claim 11, wherein the pump comprises:

a tube having:

an inner space formed therethrough by an inner surface of the tube;

a first end; and a second end opposite the first end, wherein the inner space is configured to be in fluid communication with the ink chamber via the first end, and the inner space is configured to be in fluid communication with an atmosphere via the second end; and a movable member positioned in the inner space, wherein a portion of the movable member contacts the inner surface of the tube, and the movable member selectively prevents fluid communication between the ink chamber and the atmosphere via the movable member.

14. The ink supply system of claim 13, further comprising:

a rod extending from the movable member to an outside of the tube through the second end, wherein the rod comprises a rack gear formed thereon; and a pinion gear configured to engage with the rack gear.

15. The ink supply system of claim 14, further comprising:

an ink cartridge comprising the first ink tank and the pump; and a cartridge mounting portion configured to detachably receive the ink cartridge.

16. The ink supply system of claim 15, wherein the ink cartridge is configured to be mounted to the cartridge mounting portion in a particular direction, and the ink cartridge comprises a front face, wherein the rod is configured to extend from the front face.

17. The ink cartridge of claim 13, wherein the movable member comprises:

a piston comprising a peripheral wall facing the inner surface of the tube, the peripheral wall having a groove formed therein: and an elastic member fitted in the groove, the elastic member contacting the inner surface of the tube.

18. The ink supply system of claim 11, further comprising:

an ink cartridge comprising the first ink tank and the pump; and a cartridge mounting portion configured to detachably receive the ink cartridge.

19. An ink cartridge comprising:

an ink chamber configured to store ink therein, wherein the ink chamber is defined by at least one wall;

a side wall having a first opening formed therethrough;

a particular wall extending from the side wall toward the ink chamber, having a second opening formed therethrough, a valve accommodating chamber defined by the particular wall and configured to be in fluid communication with an outside of the ink cartridge via the first opening, and to be in fluid communication with the ink chamber via the second opening;

a valve accommodated in the valve accommodating chamber, the valve configured to move in the valve accommodating chamber to selectively allow and prevent fluid communication between the valve accommodating chamber and the outside of the ink cartridge via the first opening; and wherein the second opening is positioned above both the valve accommodating chamber and the first opening.

20. The ink cartridge of claim 19, further comprising:

a joint having a third opening formed therethrough, the joint being fitted in the first opening; and an urging member positioned in the valve accommodating chamber and configured to urge the valve toward the joint to close the third opening.

21. The ink cartridge of claim 20, wherein the first opening has a center line which is substantially perpendicular to the side wall, and the valve is configured to move along the center line, and the urging member is configured to urge the valve along the center line.

22. The ink cartridge of claim 19, wherein the valve accommodating chamber comprises an end opposite the first opening, the particular wall comprises an end wall defining the end of the valve accommodating chamber, and the end wall has a third opening formed therethrough, wherein the valve accommodating chamber is configured to be in fluid communication with the ink chamber via the third opening, and the third opening is positioned below the second opening.

23. The ink cartridge of claim 19, further comprising a communication path, and the ink chamber comprises an upper portion, wherein the communication path extends from the valve accommodating chamber via the second opening to the upper portion of the ink chamber.

24. The ink cartridge of claim 23, wherein an air layer is formed in the upper portion of the ink chamber between a surface of the ink and at least a portion of the at least one wall of the ink chamber.

25. The ink cartridge of claim 24, further comprising a pump configured to selectively supply air to the air layer and to draw air from the air layer.

26. The ink cartridge of claim 23, wherein the communication path comprises:

a first portion extending from the valve accommodating chamber in a first direction, wherein the first portion has a first end connected to the valve accommodating chamber, and a second end opposite the first end; and a second portion extending from the first portion in a second direction perpendicular to the first direction, wherein the second portion has a first end connected to the second end of the first portion, and a second end opposite the first end of the second potion; and a third portion extending from the second portion in the first direction, wherein the third potion has a first end connected to the second end of the second portion, and a second end opposite the first end of the third potion, wherein the first direction is a direction in which the side wall extends.

27. The ink cartridge of claim 26, further comprising a buffer chamber provided in the second portion of the communication path.

28. The ink cartridge of claim 23, further comprising a particular check valve provided in the communication path, wherein the particular check valve is configured to selectively prevent and allow fluid to communicate between the valve accommodating chamber and the ink chamber via the communication path.

29. The ink cartridge of claim 28, wherein the particular check valve is provided in the second portion of the communication path.

30. The ink cartridge of claim 28, wherein the particular wall has a third opening formed therethrough, wherein the valve accommodating chamber is configured to be in fluid communication with the ink chamber via the third opening.

31. The ink cartridge of claim 30, further comprising a further check valve provided at the third opening, wherein the further check valve is configured to selectively prevent and allow fluid to communicate between the ink chamber and the valve accommodating chamber via the third opening.

32. The ink cartridge of claim 23, further comprising a movable member disposed in the ink chamber, wherein the movable member is configured to move when an amount of ink stored in the ink chamber changes.

33. The ink cartridge of claim 19, wherein the particular wall has a third opening formed therethrough, and the valve accommodating chamber is configured to be in fluid communication with the ink chamber via the third opening.

34. The ink cartridge of claim 33, further comprising a further valve provided at the third opening, wherein the further valve is configured to selectively prevent and allow fluid to communicate between the ink chamber and the valve accommodating chamber via the third opening.

* * * * *